US012729556B2

(12) United States Patent
Deigert

(10) Patent No.: US 12,729,556 B2
(45) Date of Patent: Sep. 8, 2026

(54) SYSTEMS, METHODS AND APPARATUS FOR RESILIENT GERT HAUNCH MOMENT FRAME CONNECTION

(71) Applicant: Cal Poly Corporation, San Luis Obispo, CA (US)

(72) Inventor: Michael J Deigert, San Luis Obispo, CA (US)

(73) Assignee: Cal Poly Corporation, San Luis Obispo, CA (US)

( * ) Notice: Subject to any disclaimer, the term of this patent is extended or adjusted under 35 U.S.C. 154(b) by 656 days.

(21) Appl. No.: 18/144,842

(22) Filed: May 8, 2023

(65) Prior Publication Data

US 2023/0392404 A1 Dec. 7, 2023

Related U.S. Application Data

(60) Provisional application No. 63/348,083, filed on Jun. 2, 2022.

(51) Int. Cl.
*E04H 9/02* (2006.01)
*E04B 1/24* (2006.01)

(52) U.S. Cl.
CPC ..... *E04H 9/021* (2013.01); *E04H 9/024* (2013.01); *E04B 1/2403* (2013.01); *E04B 2001/2415* (2013.01); *E04B 2001/2418* (2013.01); *E04B 2001/2442* (2013.01)

(58) Field of Classification Search
CPC . E04H 9/021; E04H 9/024; E04B 2001/2457; E04B 2001/2466; E04B 1/2403; E04B 2001/2415; E04B 2001/2418; E04B 2001/2442; E04B 2001/2448
USPC ..... 52/167.1, 234, 236.6
See application file for complete search history.

(56) References Cited

U.S. PATENT DOCUMENTS

| | | | | |
|---|---|---|---|---|
| 6,073,405 | A * | 6/2000 | Kasai | E04B 1/2403 52/283 |
| 6,739,099 | B2 * | 5/2004 | Takeuchi | E04C 3/04 52/289 |
| 7,497,054 | B2 * | 3/2009 | Takeuchi | E04B 1/2403 403/403 |
| 7,874,120 | B2 * | 1/2011 | Ohata | E04B 1/2403 52/655.1 |
| 9,506,239 | B2 * | 11/2016 | Houghton | E04H 9/024 |
| 10,179,991 | B2 * | 1/2019 | Houghton | E04H 9/021 |
| 10,316,507 | B2 * | 6/2019 | Richards | E04H 9/024 |
| 10,415,230 | B1 * | 9/2019 | Abbas | E04B 1/98 |

(Continued)

*Primary Examiner* — Brian E Glessner
*Assistant Examiner* — Adam G Barlow
(74) *Attorney, Agent, or Firm* — Meunier Carlin & Curfman LLC

(57) ABSTRACT

A system, method and apparatus of connecting a beam to a column includes a haunch including a first haunch side coupled to a first side of the beam and a bend plate secured to a first end of the haunch. The haunch is coupled to the column by the bend plate separated from the column by a spacer plate. A top plate extends a first distance along a top surface of the beam and the top plate includes a column opening encompassing the column, the top plate is secured to the top surface of the beam. A first edge of the spacer plate can be separated from a second haunch side by a yielding region, wherein the second haunch side is opposite from the first haunch side. The bend plate can be welded to the first end of the haunch.

13 Claims, 15 Drawing Sheets

(56) References Cited

U.S. PATENT DOCUMENTS

| | | | | |
|---|---|---|---|---|
| 10,633,851 | B2 * | 4/2020 | Mou | E04H 9/024 |
| 10,907,374 | B2 * | 2/2021 | Richard | E04H 9/027 |
| 11,162,260 | B2 * | 11/2021 | Pryor | E04H 9/024 |
| 2004/0244330 | A1 * | 12/2004 | Takeuchi | E04H 9/024 52/831 |
| 2018/0002914 | A1 * | 1/2018 | Lee | E04B 1/2403 |
| 2018/0347222 | A1 * | 12/2018 | Richards | E04H 9/021 |
| 2019/0249410 | A1 * | 8/2019 | Richards | E04H 9/024 |
| 2020/0109556 | A1 * | 4/2020 | Pryor | E04H 9/024 |

* cited by examiner

HOW ARE SHIM PLATE DISCUSSED AND SHOULD IT BE SHOWN HERE, TOP PLATE COULD BE WELDED AS WELL

SYSTEMS, METHODS AND APPARATUS FOR RESILIENT GERT HAUNCH MOMENT FRAME CONNECTION

CROSS REFERENCE TO RELATED APPLICATIONS

This application claims priority from U.S. Provisional Patent Application No. 63/348,083 filed on Jun. 2, 2022 and entitled "Systems, Methods and Apparatus for Resilient Gert Haunch Moment Frame Connection and Rolling Pendulum Base Isolation," which is incorporated herein by reference in its entirety for all purposes.

FIELD OF THE DISCLOSURE

The present disclosure relates generally to systems and methods for improving structures resiliency to lateral forces including seismic and wind forces.

BACKGROUND

Earthquake and wind prone locales typically require some type of system to reduce damage to the structure incurred during lateral force incidents such as an earthquake or wind or other lateral force events that may cause the structure to partially or fully collapse or otherwise become unstable and/or unrepairable.

The typical approach to reducing structural collapse due damage caused by an earthquake is to increase the overall strength of the structural members. The overall strength of the structural members is typically increased by making larger and/or thicker metal and/or concrete structural members in the joints where the metal and/or concrete structural members connect together. These larger/thicker structural member connections effectively make the structural members stiffer and less able to flex during an earthquake event. As a result, the stiffer, less flexible structures are able to resist failure to a particular amount of earthquake force and/or a particular amount of flex of the structure caused by the earthquake forces imparted to the structure. Once either of the force or flex limits are exceeded, the structure suffers near complete structural failure, resulting in a catastrophic collapse. Further, the structural members that do not fail but are only damaged by an earthquake event are not repairable. As a result of the structural member damage, the only option available after earthquake caused damage is complete demolition of the entire structure. It is in this context that the following embodiments arise.

SUMMARY

Several exemplary embodiments systems, methods and apparatus for improving resiliency of structures will now be described. It will be apparent to those skilled in the art that the present disclosure may be practiced without some or all of the specific details set forth herein. It should be appreciated that the present disclosure can be implemented in numerous ways. Several inventive embodiments of the present disclosure are described below.

In at least one implementation includes an apparatus including a column, a beam and a haunch. The haunch includes a first haunch side coupled to a first side of the beam and a bend plate secured to a first end of the haunch, the haunch coupled to the column by the bend plate separated from the column by a spacer plate. A top plate can also be included. The top plate extends a first distance along a top surface of the beam and the top plate includes a column opening encompassing the column, the top plate being secured to the top surface of the beam. A first edge of the retainer plate can be separated from a second haunch side by a yielding region, wherein the second haunch side is opposite from the first haunch side. The bend plate can be welded to the first end of the haunch.

The apparatus can also include a shear tab coupled to the column and aligned with a web of the beam. The shear tab includes a shear tab pivot and at least one shear tab slot. The web of the beam includes a rotation opening aligned to the shear tab pivot and at least one shear tab opening aligned with the at least one shear tab slot. A first shear tab bolt secures the web of the beam to the shear tab through the at least one shear tab slot and the at least one shear tab opening. A second shear tab bolt can optionally secure the web of the beam to the shear tab through the shear pivot and the rotation opening. Alternatively, a pivot pin can be installed in the shear tab pivot and the rotation opening.

In another alternative implementation, a coupling apparatus can include a haunch. The haunch includes a beam segment including a haunch length less than a length of a beam, a first haunch end, a second haunch end opposite from the first haunch end, and a haunch cross sectional size. A bend plate is also included. The bend plate is coupled to the first haunch end. The bend plate extends across a depth of the haunch and further extends across a yielding length and a retainer plate length of a retainer plate. A spacer plater is disposed between the bend plate and a first side of a column. The spacer plate having a spacer plate thickness equal to a yielding gap. The spacer plate having a spacer plate length equal to the length of the retainer plate. At least one removable haunch bolt secures the haunch to a first side of the beam, the at least one haunch bolt extends through the first side of the haunch and the first side of the beam. The bend plate is offset from a first side of the column by the yielding gap. The retainer plate is disposed on an opposite side of the bend plate from the spacer plate and offset from a bottom of the haunch by the yielding length. At least one retainer bolt passing through the retainer plate, the bend plate, the spacer plate and at least one side of the column, the at least one retainer bolt securing the retainer plate, the bend plate, the spacer plate to the at least one side of the column. A shear tab is coupled to the first side of the column, the shear tab includes a shear tab pivot and an upper shear tab slot formed a first distance above a centerline of the pivot and a lower shear tab slot formed the first distance below the centerline of the pivot. A substantially round rotation opening is formed in the beam corresponding to and aligned with the shear tab pivot, the pivot opening having a diameter substantially equal to a diameter of the shear tab pivot. An upper shear tab bolt and a lower shear tab bolt passing through the beam and securing the beam to the upper and lower shear tab slots. A top plate can also be included to secure the beam to the column. The top plate includes a column opening encompassing the column and a top plate length extending along a first portion of the beam on a second side of the beam opposite from the first side of the beam, the top plate being secured to the beam by bolts, rivets or welds or equivalents and combinations thereof.

Another implementation can include a method for securing a beam to a column using a haunch, a top plate and a bend plate.

Other aspects and advantages of the disclosure will become apparent from the following detailed description, taken in conjunction with the accompanying drawings, illustrating by way of example the principles of the disclosure.

BRIEF DESCRIPTION OF THE DRAWINGS

The present disclosure will be readily understood by the following detailed description in conjunction with the accompanying drawings.

DETAILED DESCRIPTION

Figure 1A:
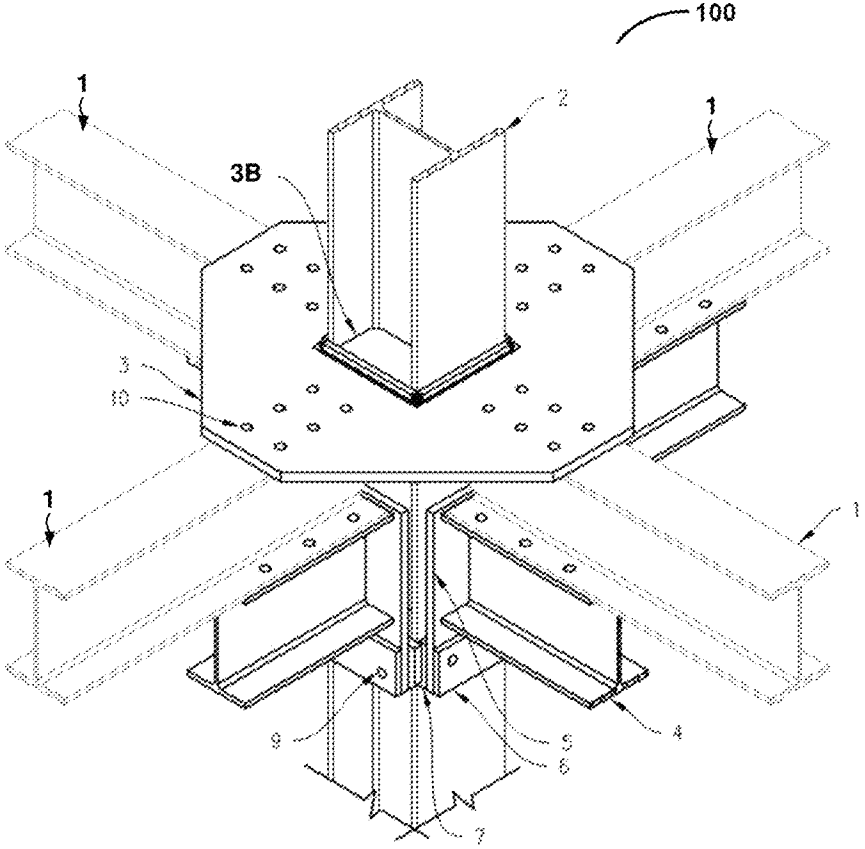
FIG. 1A is a schematic diagram of the Gert Haunch connection connecting one or more horizontal beams to a W-shaped vertical column, for implementing embodiments of the present disclosure.

Several exemplary embodiments for systems, methods and apparatus for improving resiliency of structures will now be described. It will be apparent to those skilled in the art that the present disclosure may be practiced without some or all of the specific details set forth herein.

The Jan. 17, 1994, Northridge earthquake in Los Angeles, California illustrated how little structural engineers understood the actual performance of structural steel moment frame connections. The investigation of steel moment frame connection failures after the Northridge earthquake have led to extensive efforts, both privately and federally funded, to develop predictable and more ductile engineered solutions for steel moment frames where improved ductility includes the ability of the steel moment frame connections to be drawn or plastically deformed without fracture. A steel moment frame includes structural steel framing members. The structural steel framing members typically include multiple vertical columns and multiple, substantially horizontal beams. The columns and beams are joined together in such a manner that the connected joints can resist moments. The joints for steel moment frames for building structures resist moments developed from the frame resisting the lateral displacement of the building that may be generated from the effects of wind or seismic forces.

The American Institute of Steel Construction (AISC) of Chicago, Il, is an industry organization that, among many activities, formulates and publishes steel construction standards that provide guidance to industry acceptable steel construction practices for structural designers, constructors and building codes. AISC relies on numerous methods to 'pre-qualify" various steel construction practices. The pre-qualified construction practices are then published as a corresponding AISC standard suitable for structural designers, constructors and building codes to refer to and rely on as a structure is designed, built and inspected. An example AISC standard is "Prequalified Connections for Special and Intermediate Steel Moment Frames for Seismic Applications", which is incorporated by reference in its entirety and for all purposes and hereafter referred to herein as "AISC 358."

AISC 358 standard currently defines 10 prequalified steel moment frame connections that have been tested to confirm currently acceptable ductility at or near the beam-column joint. A beam-column joint is where a vertical column connects to a horizontal beam in the steel moment frame of a structure. Special Moment Frame connections (SMF) are the most ductile and require the greatest amount of rotation in the beam to column connection and require the use of one of these 10 AISC 358 pre-qualified connections. Steel moment frames of structures typically experience large deformations, including rotations, when subjected to lateral forces due to the high flexibility of the steel moment frames compared to other lateral force resisting systems. The 10 AISC 358 prequalified connections are designed to be ductile and accommodate the significant deformations caused by seismic events in an attempt to reduce structural collapse of the steel moment frame of a structure. However, the 10 AISC 358 pre-qualified connections are far from perfect solutions to building earthquake and other lateral force resilient structures.

A new beam to column connection is described in more detail, as follows, and referred to herein as a "Gert Haunch connection." Experimental testing shows significant advantages in the performance of the Gert Haunch connection when compared to the 10 AISC 358 pre-qualified connections. The Gert Haunch connection includes a wraparound column top plate, a replaceable haunch and a bend plate. The column top plate surrounds the vertical column and is secured (e.g., bolted, welded, riveted, etc.) to an end of the horizontal beam. The haunch is bolted to the end of the horizontal beam. The bend plate is capable of flexing and bending and acts as a ductile fuse to dissipate energy while allowing the horizontal beams and vertical columns of the steel moment frame of a structure to remain elastic. The Gert Haunch connection has the added benefit of providing additional strength and stiffness to the moment frame connection and overall drift of the frame. Drift, as described herein, refers to a horizontal movement of the building with respect to the ground below the steel moment frame of the structure.

The Gert Haunch connection design accommodates various configurations of column sizes, shapes, and materials, W-shaped sections in strong axis bending were used for both the beam and column for testing. AISC 341-16 "Seismic Provisions for Structural Steel Buildings," standard, which is incorporated by reference in its entirety and for all purposes, provides the standard testing processes for evaluating the function, flexibility and strength of steel moment frame connections. The Gert Haunch connection testing was conducted in accordance with the AISC 341-16 cyclic loading protocol to determine the connection's ductility performance as well as the strength and stiffness characteristics unique to the Gert Haunch connection. As used herein, a wide flange is part of a modern I-beam. An I-beam has an I-shaped cross-sectional shape. The I-beam includes flanges on the top and bottom and a web spanning between the flanges. Traditional I-beams were more I-shaped but many years ago engineers determined that designing beams that had wider flanges, e.g., wide flange, and skinner webs, were much more efficient and stiffer than the traditional I-beam. The wide flange I-beam, is herein after referred to as a W-shaped beam.

Figure 1B:
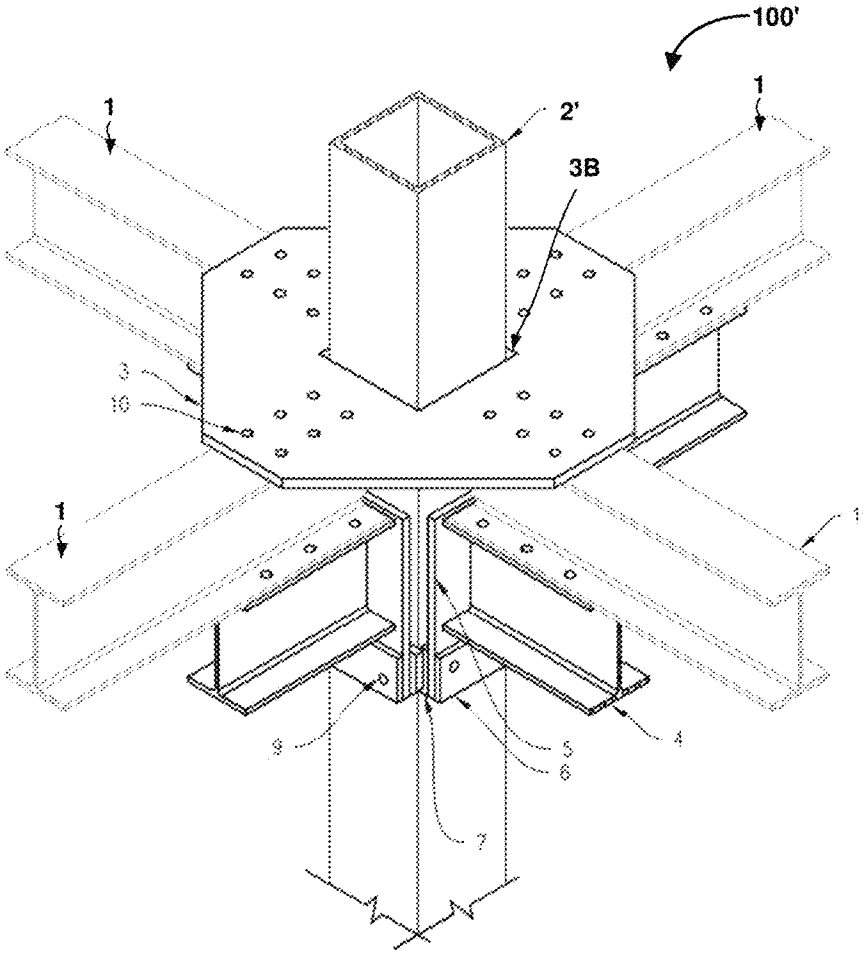
FIG. 1B is a schematic diagram of the Gert Haunch connection connecting one or more horizontal beams to a square cross-section beam vertical column, for implementing embodiments of the present disclosure.

FIG. 1A is a schematic diagram of the Gert Haunch connection 100 connecting one or more horizontal beams 1 to a W-shaped vertical column 2, for implementing embodiments of the present disclosure. FIG. 1B is a schematic diagram of the Gert Haunch connection 100' connecting one or more horizontal beams 1 to a square cross-section beam vertical column 2', for implementing embodiments of the present disclosure. The primary ductile element in the Gert Haunch connection is the bend plate 5 which controls the performance of the connection. The bend plate 5, as shown in FIGS. 1A, 1B, serves as the yielding element in the frame (i.e., physical, ductile fuse) by providing ductility in the beam to column connection when subjected to lateral loading due to lateral loading events.

Isolating the yielding of the beam to column connection away from the steel moment frame beam with the bend plate as a ductile fuse, allows the beam and Gert Haunch connection assembly to remain elastic while still providing ductility in the steel moment frame system. In the event the bend plate is damaged by excessive flexing, such as in a seismic event, the Gert Haunch can be unbolted and replaced without requiring any major replacements to the beam or column.

The Gert Haunch connection is adaptable to a variety of construction types and materials. As shown in FIGS. 1A, 1B, the Gert Haunch connection 100, 100' can be utilized with a variety of column cross sections and provide either uniaxial or biaxial restraint as required. This allows for unique configurations including weak axis wide-flange moment frames. W-shape members have a strong axis and a weak axis of bending. The strong axis of bending is defined by a line perpendicular to the web of the W shape, which bending of the beam as to cause tension and compression forces over the width of the flanges of the column. The weak axis is defined by a line that is parallel and passing through the center of the web beam as to cause tension and compression forces at the ends of the flanges of the column. As shown in FIG. 1A, there are horizontal beams in both directions, north-south and east-west, the beams in one direction will bend the column in strong axis bending while the beams in the other direction will bend the column in the weak direction. In the case of the square shaped column there is no strong and weak axis, they are symmetrical and equal in bending strength. A rectangular shape column is not symmetrical and would have a weak and strong axis of bending. In pre-Northridge Earthquake construction, steel moment frame connections were allowed to be designed for both weak and strong axis. Since then, there are essentially no weak axis pre-qualified steel moment frame connections, which means that order to resist forces in the opposite direction another column must be used and rotated in the strong direction.

The exemplary implementations described herein are preliminary analyses of the Gert Haunch connection and therefore focused on the uniaxial performance of a single beam-column connection. Testing was performed in accordance with the AISC 341-16 procedure for prequalification of Special Moment Frame Connections. The following sections describe the Gert Haunch connection testing.

Figure 2:
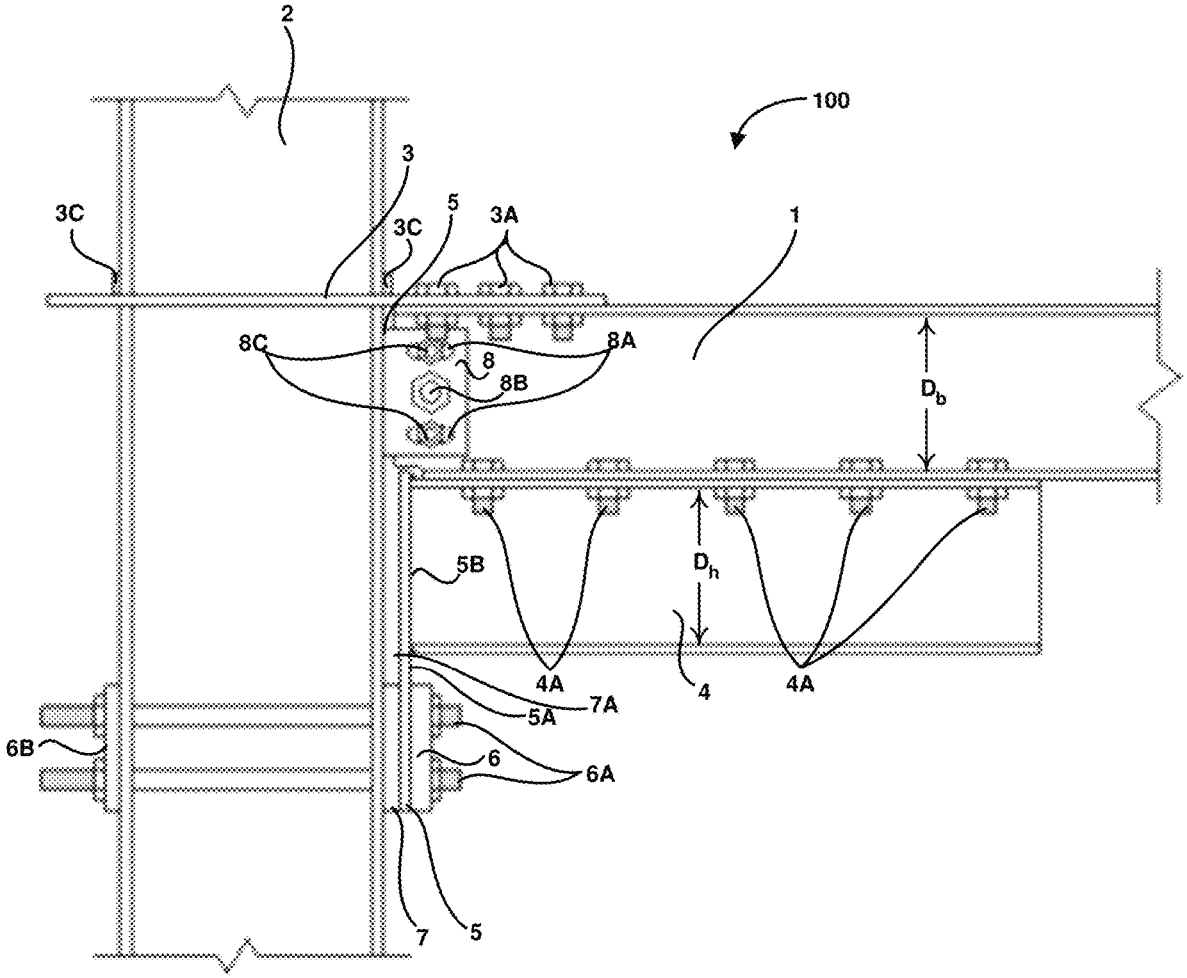
FIG. 2 is a more detailed, side view schematic diagram of the Gert Haunch connection, for implementing embodiments of the present disclosure.

FIG. 2 is a more detailed, side view schematic diagram of the Gert Haunch connection 100, for implementing embodiments of the present disclosure. The Gert Haunch connection 100 includes three primary elements with additional supplementary parts that complete the connection to the moment frame beam and column.

The first element, is the haunch 4, is a supplementary, W-shaped cross section segment of a beam that is bolted to the horizontal beam 1 with multiple haunch threaded fasteners 4A (e.g., bolts or threaded rods). The haunch 4 provides additional strength and stiffness to the beam 1 to column 2 connection, as well as provide a ductile fuse for the frame. Connecting the haunch 4 to the beam 1 with haunch bolts 4A allows the haunch to be replaceable without requiring replacement or cutting or other modification of the beam.

Figure 3A:
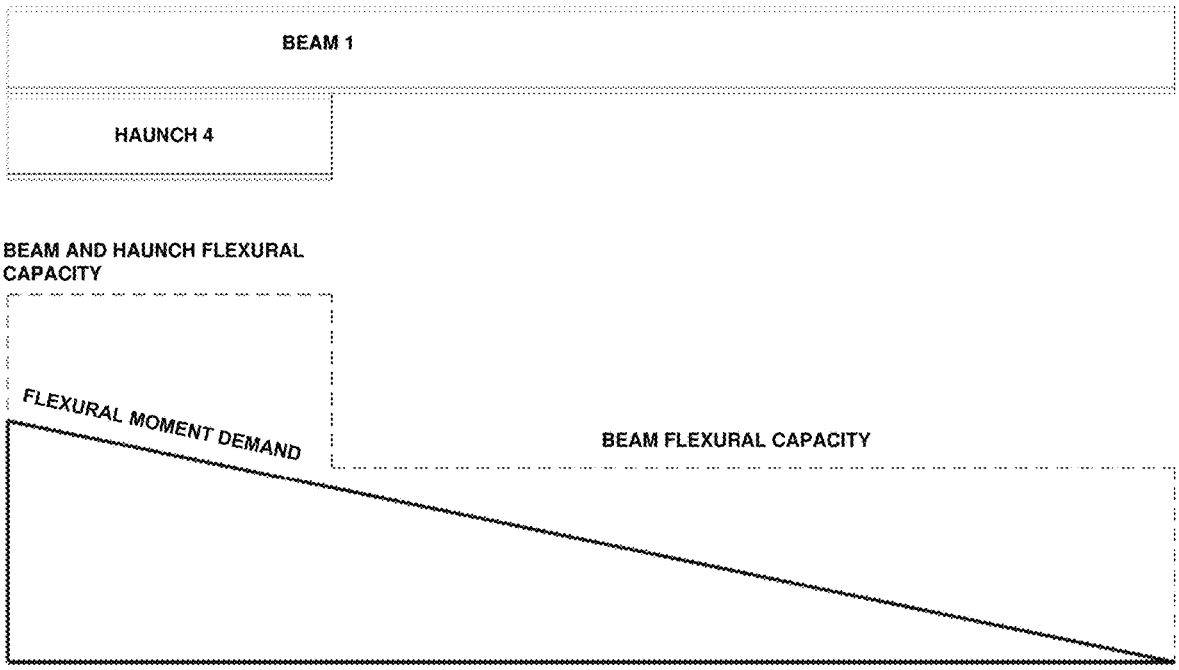
FIG. 3A is a graph illustrating the relative beam and haunch moment demand and corresponding capacities for accommodating the flexural moment demand, for implementing embodiments of the present disclosure.

FIG. 3A is a graph illustrating the relative beam and haunch moment demand and corresponding capacities for accommodating the flexural moment demand, for implementing embodiments of the present disclosure. The introduction of the Gert Haunch connection provides additional, beam and haunch flexural capacity (i.e., bending or flexing capacity) for the beam 1 in the region to the left portion beam and haunch capacity, corresponding to the end portion of the beam 1 that overlaps the haunch 4, where the moment demands are the greatest and terminates where the demands are lower. This allows the beam to sustain higher moment demands at the ends without requiring a larger, full-length of the beam, cross section. The Gert Haunch connection also allows for a moment capacity at the connection to be greater than that of the beam 1 alone.

The haunch length and haunch cross section dimensions of the haunch 4 can be varied to optimize efficiency and the design requirements. The haunch cross-section size can be equal to, less than or greater than the beam cross-section size of the beam 1, where the cross-section size includes the depth of the web portion of the beam, as measured from the top of the beam to the bottom of the beam. The haunch effectively increases the cross-section size of the end portion of the beam. Increasing the cross-section size at the ends of the beam 1, where the moment demand is the largest, significantly increases the stiffness of the entire frame of the structure, even with relatively short haunch lengths. Moment frames (e.g., the entire structural framework that includes the beam 1 and column 2) are typically governed by drift demand rather than strength demands, so the addition of the haunch can reduce beam and column section sizes while maintaining the stiffness of the frame. As a result, smaller beam and column sizes reduce costs and weight of the steel moment frame.

Figure 8A:
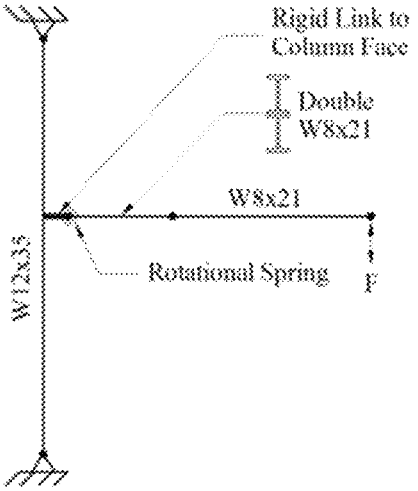
FIG. 8A is a graphical representation of the flexibility due to the rotation of the connection modeled as a rotational spring at the face of the column, for implementing embodiments of the present disclosure.
Figure 8B:
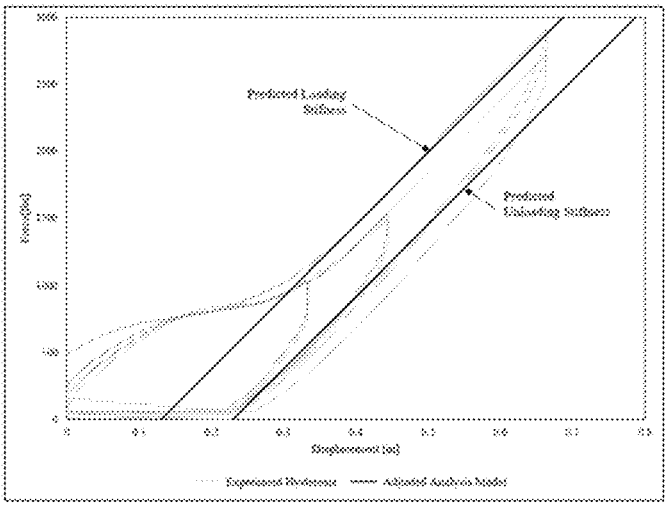
FIGS. 8B and 8C are graphical representations of the values that were applied to a software analysis model of the test frame and compared to experiment results, for implementing embodiments of the present disclosure.
Figure 8C:
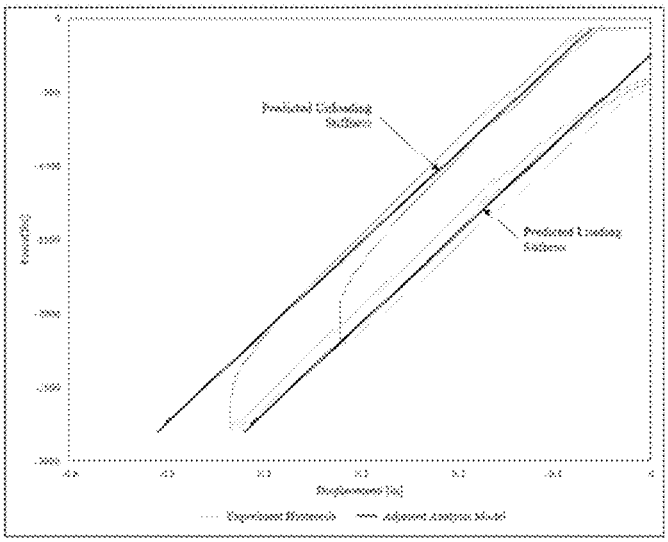
Figure 8D:
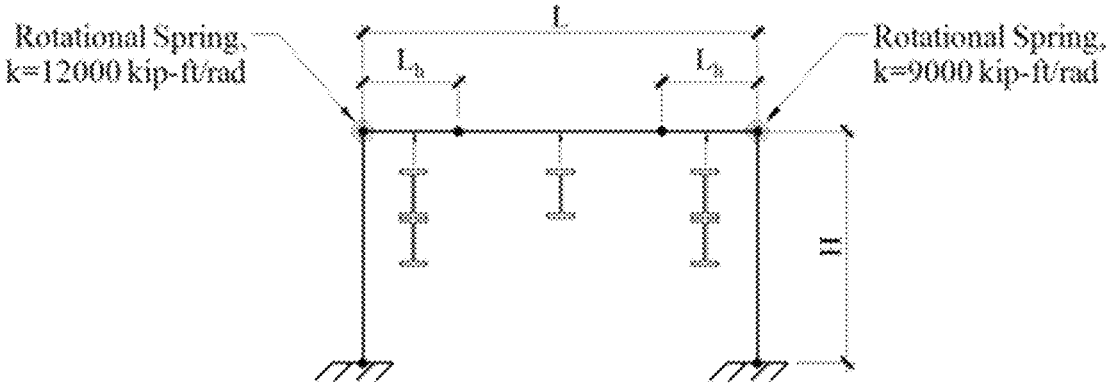
FIG. 8D is a schematic diagram of a generalized layout of the frame geometry, for implementing embodiments of the present disclosure.
Figure 8E:
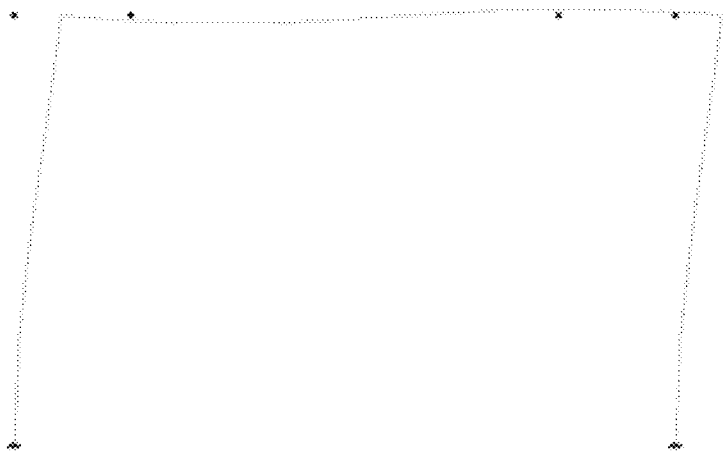
FIG. 8E is a graphical representation of a deflected shape from a sample analysis model, for implementing embodiments of the present disclosure.
Figure 8F:
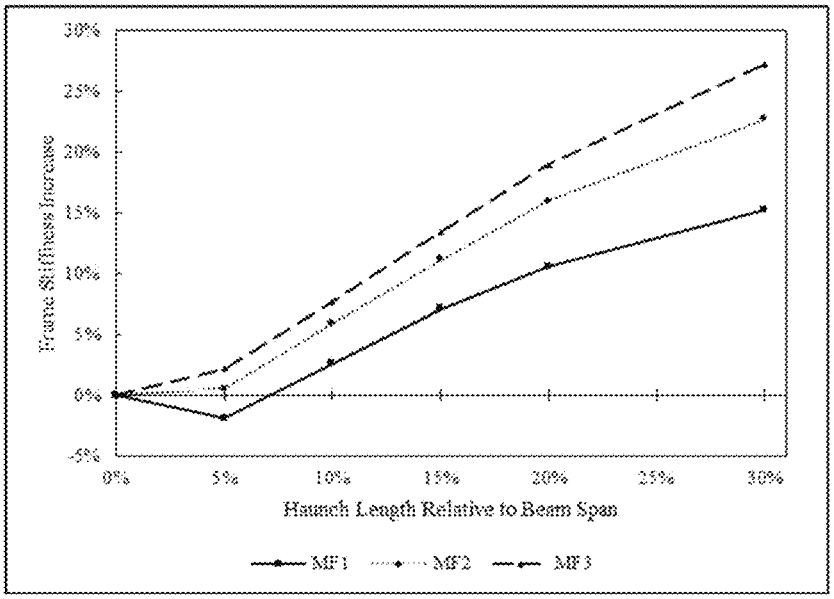
FIG. 8F is a graphical representation of the parametric data, for implementing embodiments of the present disclosure.

The length of the haunch (e.g., haunch length) can be equal to or greater than the cross-section size of the haunch. The maximum length of the haunch 4 is limited only by the length of the beam 1, however, it is intended that the haunch length will be substantially less than the length of the beam. Using a Gert Haunch connection between a beam 1 and a column 2, allows a smaller cross sectional size beam, thus reducing material cost without sacrificing strength of the entire frame of the structure. The haunch 4 illustrated and described herein have the same cross-sectional size as the beam 1, however, this was chosen for simplicity of assembly. It should be understood that the haunch 4 and the beam 1 can have different cross-sectional shapes while the haunch would still improve the strength of the beam to column connection. The haunch 4 can have any selected length as compared to the length of the beam 1. Almost any length of haunch will add to the overall stiffness of the moment frame, the increase in stiffness is dependent on the overall length of the beam. The data shown in Tables 1 & 2 and FIG. 8F compares the length of the haunch as a percentage of the overall length of the beam. This percentage varied from 5% to 30%. At 5% the added stiffness was notable. Three different lengths of the beam 1 were analyzed and the data showed the most significant improvement in stiffness was provided with the longest beam and the least improvement in stiffness was with the shortest beam. One interpretation is that short moment frames are inherently very stiff, whereas longer moment frames are more flexible and therefore have a greater opportunity for increased stiffness. It should also be noted that the data is based on the tested Gert haunch connection which was somewhat under designed so that the ductility fuse would occur at the desired location (i.e. the bend plate). An increase in overall stiffness of the moment frame will significantly increase as the stiffness of the Gert haunch connection is increased up to a maximum stiffness that still allows the fuse to develop at the bend plate and also limit damage to the other moment frame members.

The horizontal beam is typically reduced in strength at the connection to the vertical column so that the horizontal beam itself acts as a physical fuse if the moment frame structure is flexed too far, such as during a seismic event. However, using the horizontal beam as the physical fuse weakens the overall moment frame structure and could result in structural failure and collapse of the entire moment frame structure during lateral loads caused by a seismic event.

The second element of the Gert Haunch connection is the bend plate 5. The bend plate provides a primary yielding element in the Gert Haunch connection. The bend plate can be shop-welded or field-welded to the haunch 4, parallel to the cross-section of the haunch, along the bend plate weld 5B, to extend to the connecting elements below the haunch.

Figure 3B:
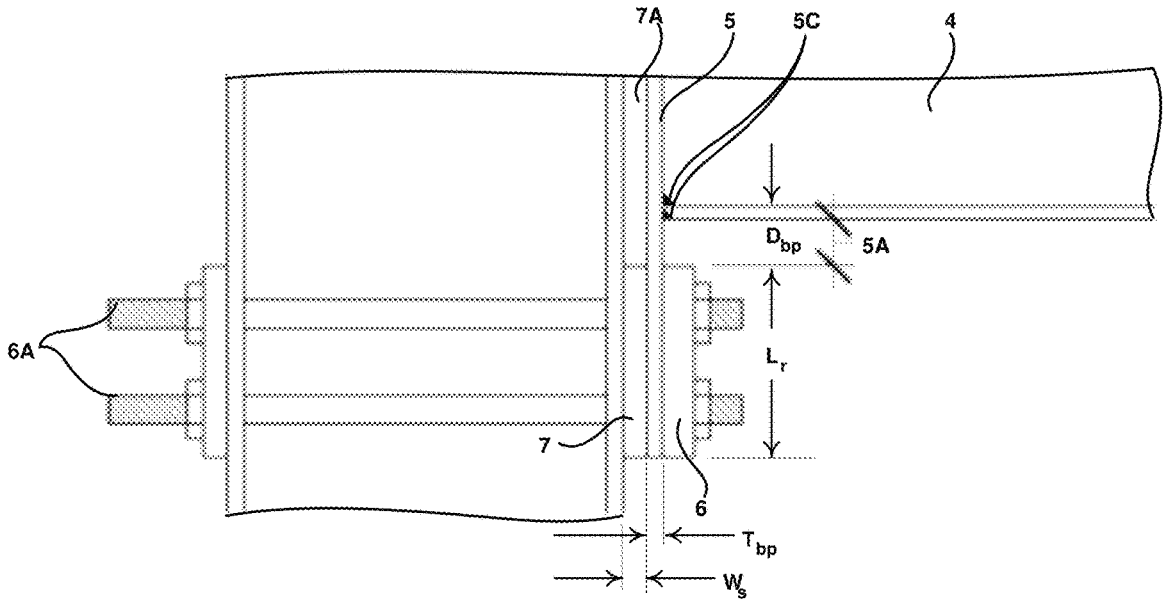
FIG. 3B is a detailed schematic view of a first end of the haunch 4, for implementing embodiments of the present invention.

FIG. 3B is a detailed schematic view of a first end of the haunch 4, for implementing embodiments of the present invention. The bend plate extends below the haunch 4 and a series of additional plates 6, 7 and threaded fasteners 6A, e.g., threaded rods or bolts, secure the bend plate in place. A desired bending and yielding region 5A of the bend plate 5 is defined by the distance Db p between the haunch 4 and the plates 6, 7.

The spacer plate 7 fills a lower portion of the yielding gap 7A between the bend plate 5 and the column face while the retainer plate 6 clamps the bend plate to the spacer plate. The spacer plate 7, retainer plate 6 and bend plate 5 are held together by threaded rods 6A which extend through at least a portion of the column 1 section to an optional plate 6B, if needed, on an opposite flange of the column 2. This bend plate, spacer plate and retainer plate assembly creates the yielding region 5A between the top of the retainer plate 6 and the bottom of the haunch 4, as shown in FIGS. 2 and 3B.

The yielding region 5A has a yielding length of distance Db p, between the top of the plate 6, 7 and the bottom of the haunch 4. In at least one implementation, the bend plate 5 has a minimum length equal to sum of a depth Dh of the haunch 4 plus the yielding length Db p plus a length L r of the retainer plate 6. The spacer plate 7 thickness defines the width W s of the yielding gap 7A. It should be understood the bend plate can have a substantially larger or smaller length than described in the above example, in one or more alternative implementations. The spacer plate thickness and yielding gap width W s have a minimum dimension of about twice the thickness Tb p of the bend plate 5. Alternatively, the spacer plate thickness and yielding gap can be substantially larger than twice the thickness of the bend plate.

Referring again to FIG. 2, the horizontal beam 1 is coupled to the vertical column 2 with one or more shear tab threaded fasteners 8B, 8C, e.g., threaded rods or bolts, to a shear tab 8. The shear tab is welded to the vertical column 2. In at least one implementation, the shear tab includes a shear tab pivot and at least one shear tab slot 8A. The web portion of the beam 1 includes a rotation opening and at least one shear tab opening corresponding to the shear tab pivot and the at least one shear tab slot, respectively.

Figure 3C:
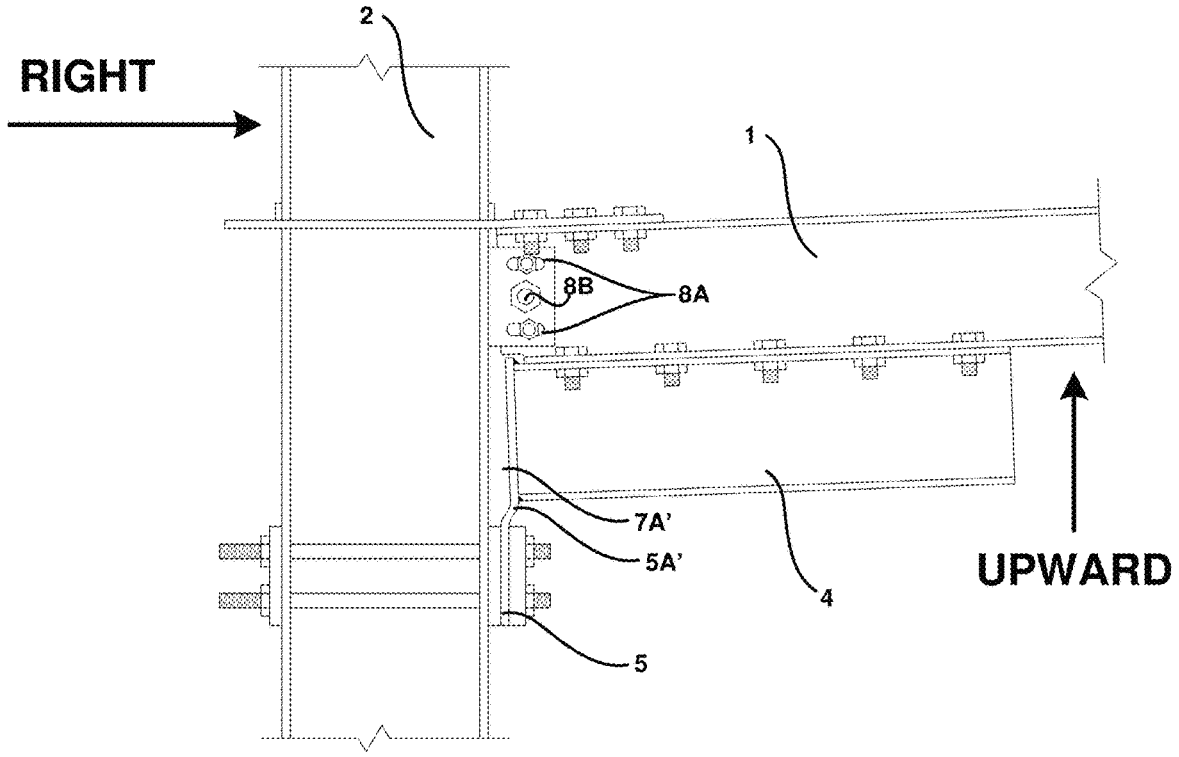
FIGS. 3C and 3D are schematic diagrams of the Gert Haunch connection for absorbing forces to the steel moment frame, for implementing embodiments of the present disclosure.
Figure 3D:
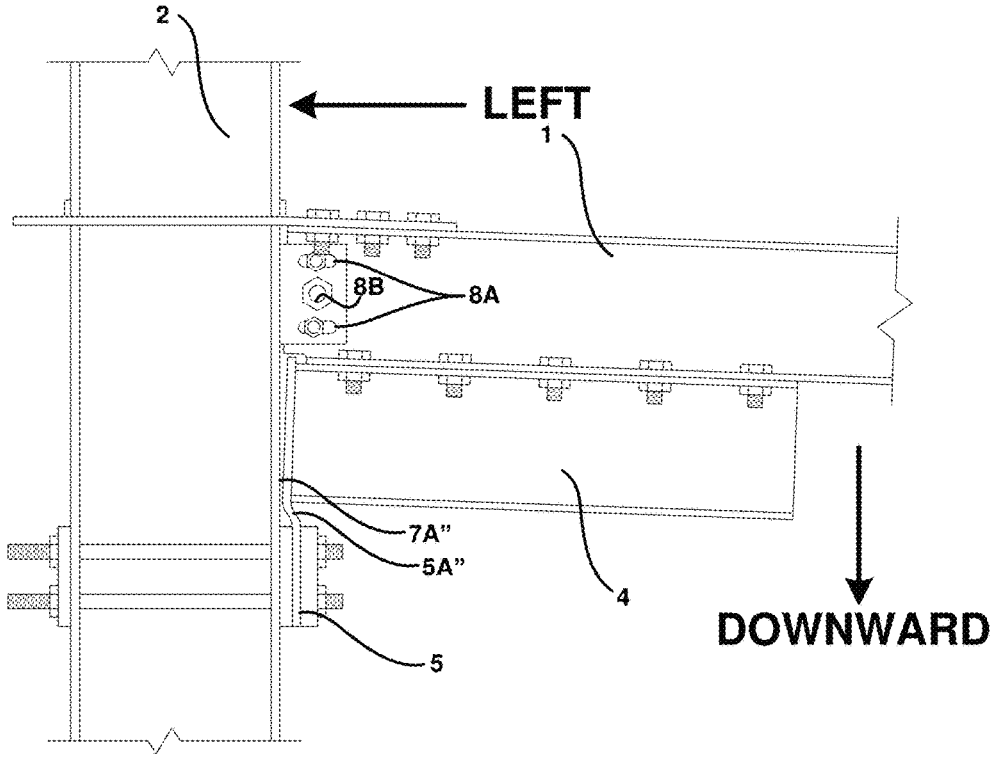

FIGS. 3C and 3D are schematic diagrams of the Gert Haunch connection for absorbing forces to the steel moment frame, for implementing embodiments of the present disclosure. Referring to FIG. 3C, as an upward force pushes the beam 1 in an upward direction, and/or a right force pushes the column 2 in a rightward direction (as shown), the beam 1 is allowed to rotate about pivot formed by a pin or pivot bolt 8B in the shear tab pivot and via the slots 8A in the shear tab 8. Upper and lower threaded fasteners 8C, e.g., threaded rods or bolts, secure the beam to the shear tab slots while also allowing horizontal movement as the upward and/or rightward forces are applied to the beam and/or column. Correspondingly, the bend plate 5 bends in double curvature in the yielding region 5A, away from the column, increasing the width of yield space 7A. It should be noted that the hole for pivot pin or bolt 8B can also be a slot in at least one implementation.

Referring to FIG. 3D, as a downward force pushes beam 1 in a downward direction and/or a left force pushes column 2 in a leftward direction (as shown), the beam is allowed to rotate about pivot bolt 8B via slots 8A in the shear tab 8. Correspondingly, the bend plate 5 bends in a double curvature in the yielding region 5A, toward the column, decreasing the width of the yield space 7A. The length of this yielding region 5A as well as the thickness of the bend plate 5 can be optimized for efficiency and to avoid damage to the beam.

As the beam rotates, the bend plate bends in double curvature in the yielding region as shown in FIGS. 3C and 3D. The length of this yielding region as well as the thickness of the bend plate can be optimized for efficiency and to avoid damage to the beam. In one example the bend plate 5A has a length of about 1.5 inches (38 mm), a width of about 6 inches (152 mm). In another example the bend plate 5A has a length of about 2 inches (50 mm) and a width of about 7 inches (178 mm). In yet another example the bend plate 5A has a length of about 3 inches (about 75 mm) and a width of about 8 inches (200 mm). In the foregoing examples, the longest bend plate length will be the weakest, assuming all the bend plates are the same thickness. The longer the length of the bend plate 5A, the less stiff the bend plate will be and is therefore easier to bend. The shorter the length of the bend plate 5A the more resistance to bending forces and therefore the shorter length bend plate will be stiffer. The bend plate 5A should have at least a minimum length in order to provide consistent, and predictable bending behavior. The width of the bend plate has less of an effect on the stiffness or strength compared to the length or thickness. To aid in fabrication, the width of the bend plate can be slightly wider than the width of the haunch so that the bend plate can be more easily welded to the end of the haunch. The thickness of the bend plate can have a significant effect on the stiffness and capacity of the Gert Haunch connection. The thicker the bend plate the harder the bend plate will be to bend, hence the stiffer the Gert Haunch connection and greater ability to resist forces. The thinner the bend plate the easier the bend plate can be to bend, hence the weaker bend plate and the reduced ability of the Gert Haunch connection to resist forces. Selecting the length and thickness of the bend plate allows tuning the desired strength and stiffness of the Gert Haunch connection to provide the appropriate rotational strength and stiffness of the overall steel moment frame while also acting as a fuse to protect other elements in the steel moment frame.

A third element of the Gert Haunch connection is the top plate 3. Referring again to FIGS. 1A, 1B and 2, in at least one implementation, the top plate 3 is removably secured to the top flange of the beam 1 with multiple top flange bolts 3A. The top plate 3 includes a column opening 3B corresponding to a column cross section. The column 1 passes through the column opening 3B and thus the top plate encompasses the column. In at least one implementation, the column opening 3B can be somewhat larger than the column and one or more gap filling shim plates can be installed to limit the space to a desired amount of flexibility in the Gert Haunch connection. In another implementation, the top plate 3 can be formed in two or more pieces that can be field installed and welded or bolted together to form the desired space around the column.

Figure 4A:
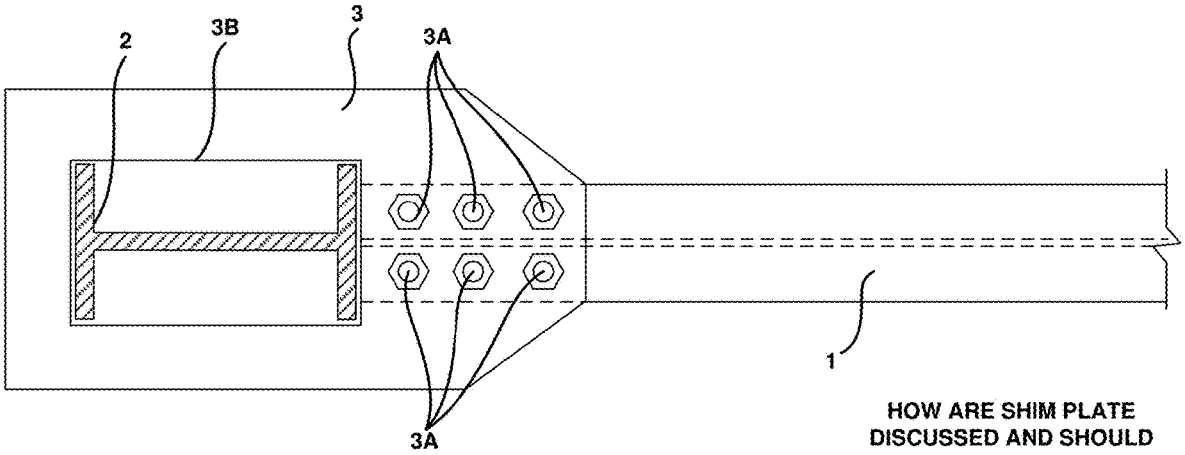
FIG. 4A is a top view schematic diagram of the top plate securing the horizontal beam to the vertical column, for implementing embodiments of the present disclosure.
Figure 4B:
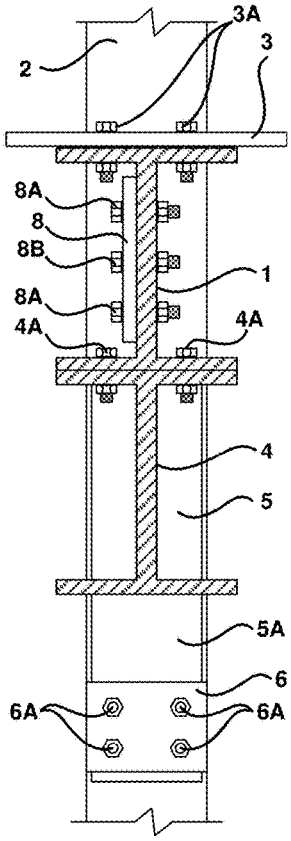
FIG. 4B is a schematic diagram of an end on view of the top plate securing the horizontal beam to the vertical column, for implementing embodiments of the present disclosure.
Figure 4D:
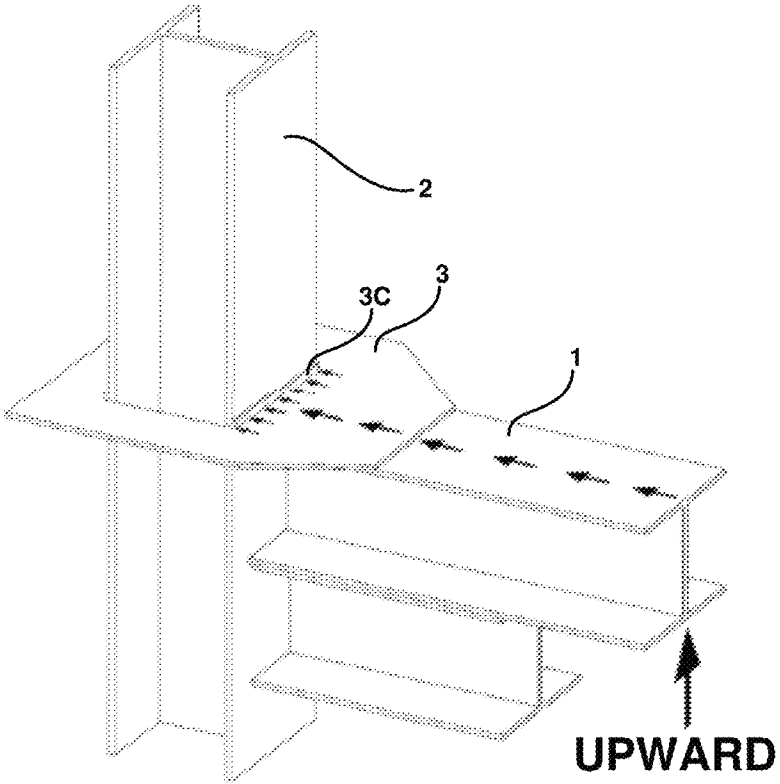
FIGS. 4C and 4D are schematic diagrams of the top plate securing the horizontal beam to the vertical column, for implementing embodiments of the present disclosure.
Figure 4C:
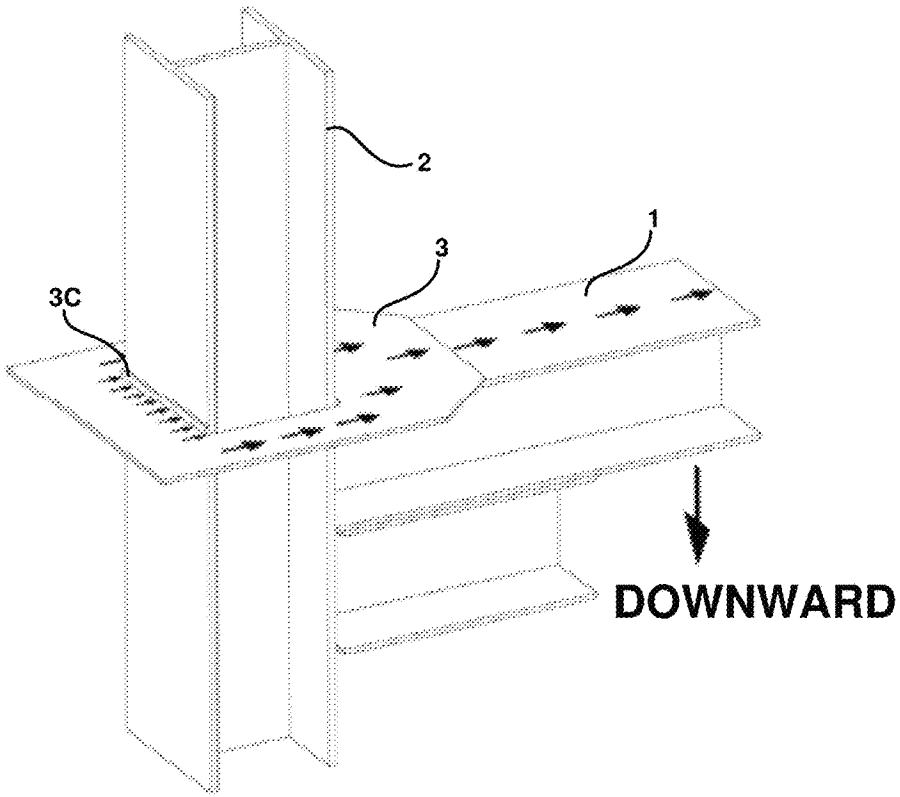

FIG. 4A is a top view schematic diagram of the top plate 3 securing the horizontal beam 1 to the vertical column 2, for implementing embodiments of the present disclosure. FIG. 4B is a schematic diagram of an end on view of the top plate 3 securing the horizontal beam 1 to the vertical column 2, for implementing embodiments of the present disclosure. FIGS. 4C and 4D are schematic diagrams of the top plate 3 securing the horizontal beam 1 to the vertical column 2, for implementing embodiments of the present disclosure. The top plate transfers flexural demand into the column exclusively through bearing. Flexural stresses in the beam 1 are transferred to the top plate 3 through bolt shear which is carried to the bearing surfaces on each side of the column through axial force in the top plate.

For constructability reasons, one or more a shim plates 3C can be field welded to the inside edge of the top plate on one or more sides (i.e., 1, 2, 3 or all four sides, either singly, or adjacent or opposite sides or both opposite and adjacent) of the column to provide full, positive bearing from the top plate to the column. This allows for the moment to be transferred to the column through plate bearing for both positive and negative moments as shown in FIGS. 4C, 4D.

By encapsulating the entire column cross-section, the top plate 3 can transfer forces into the column 1 without a field welded connection between the top plate and the column. The width of the top plate 3 is generally determined in large part by the width and shape of the column. The mechanics of the Gert Haunch connection transfers forces to the top plate 3 such that the top plate acts in tension and/or compression and bearing against the column. The axial force, tension or compression is a significant main design element for the top plate and therefore the width and thickness of the top plate on the sides of the column are selected to resist the axial forces developed in the top plate. The length of the top plate is selected to transfer the axial force at the top of the beam, which then transfers the axial force to the column through the bearing. More bolts are required to secure the top plate to the beam as the intended ability to resist axial forces increases which would require a greater length of the top plate to accommodate the additional bolts.

Standard detailing requirements can be applied to prevent potential deficiencies in the moment frame column elements. Panel zone shear in the column web should be considered by the designer. In at least one implementation a conventional doubler plate to the column web at the location of the beam connection can be combined with Gert Haunch connection to mitigate the effects of panel zone shear.

The Gert Haunch connection was tested in a uniaxial manner with a beam connected only on one side of the column. However, the Gert haunch connection can be designed to support flexural demand on both sides of the column uniaxially or biaxially. This can be accomplished by extending the top plate geometry over each beam that connects to the column and connecting the bend plate threaded rods to the bend plate on the opposing flange, as described in FIGS. 1A, 1B. For some column cross sections, additional elements may be included, such as stiffener plates for a weak-axis W-shaped column, however the overall concept of the connection remains consistent. This allows for a wide range of applications due to the adaptive nature of the connection.

The Gert Haunch connection can be assembled almost exclusively using bolted connections which simplifies the construction process. The top plate 3 can be slotted onto the column 2 before the column is lifted into place, so the top plate is ready to be attached to the beam 1. A shear tab 8 can be provided to bolt the beam into place while the remaining Gert Haunch connection elements, e.g., bend plate 5, retainer plate 6 and spacer plate 7, are attached. The bend plate can be shop or field welded to the haunch 4. The haunch can be bolted to the beam 1 and secured to the column 2 using the threaded rods 6A.

The only field welding needed on site would be from the top plate to the shim plates 3B which is a top-down straight-line weld. As a result, most of the Gert Haunch connection can be prepared offsite, e.g., in a shop environment, and assembled onsite.

Since the haunch 4 and bend plate 5 are only connected to the moment frame using bolts, the replacement process is simplified. If damage is observed in the bend plate 5 following a seismic event, the haunch 4 can be unbolted from the beam 1 and replaced with an identical Gert Haunch connection, as necessary. As shear tab 8 is still in place to support the beam, extensive shoring would likely not be required since the beam should sustain little to no damage.

It should be understood that the above-described implementations can be modified by including Gert Haunch connections in all directions of beams being coupled to a column. It should also be understood that while the above-described implementations illustrated and discussed included the haunch placed below the beam, alternative embodiments can include the haunch being mounted above the beam and the top plate becoming a bottom plate and being mounted to the bottom of the beam, in similar but substantially inverted fashion to the haunch being mounted to the bottom of the beam and the top plate being mounted to the top of the beam. In yet another implementation, the beam to column connection can include Gert Haunch connections both above and below the beam and top plates on one or both of the top surface of the beam and bottom surface of the beam.

The testing procedure applied to the Gert Haunch connection was performed in accordance with the AISC 341-16 protocol for Beam-to-Column moment connections including Loading Protocol (Drift Limits per AISC, Displacement Based) with an Instrumentation Plan.

The details shown in figures included herein depict the geometry of the Gert Haunch connection elements used in this experiment. The connection's protected zone around the bend plate is indicated with a dashed outline. The weld 5C shown in FIG. 3B is located within the protected zone at the bottom of the Gert Haunch connection. This weld 5C is designated as a complete joint penetration weld and is important to the performance of the bend plate. The weld 5C is a seismic demand critical weld and can be any suitable type of high quality weld.

The welds for the Gert haunch connection, including the demand critical weld from the haunch to the bend plate were done with the FCAW process with E70 electrode but did not incorporate the increased toughness requirements per the current AISC specifications for demand critical welds of the seismic lateral resisting system (SLRS). The weld from the haunch to the bend plate was typically a fillet weld all around with the exception of the bottom of the haunch flange to the bend plate which was a single sided PJP.

The test beam, column and Gert haunch connection were specified as A992 steel. All plate material used in the beam connections was specified as A36 steel. It should be understood that the Gert Haunch connection can be formed from any suitable metal members. The test frame used in this experiment was constructed in the testing facility by researchers and laboratory staff. All testing elements were connected to concrete foundation blocks which were anchored to the laboratory strong floor.

Figure 5A:
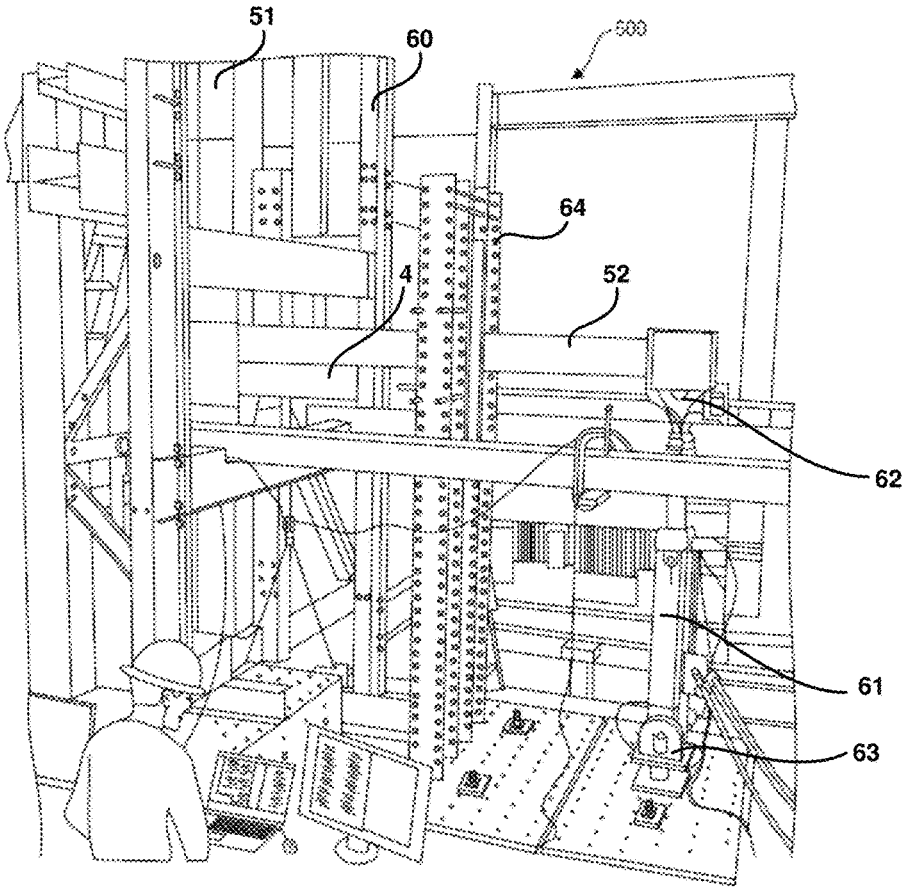
FIG. 5A is a pictorial view of the Gert Haunch test fixture, for implementing embodiments of the present disclosure.
Figure 5B:
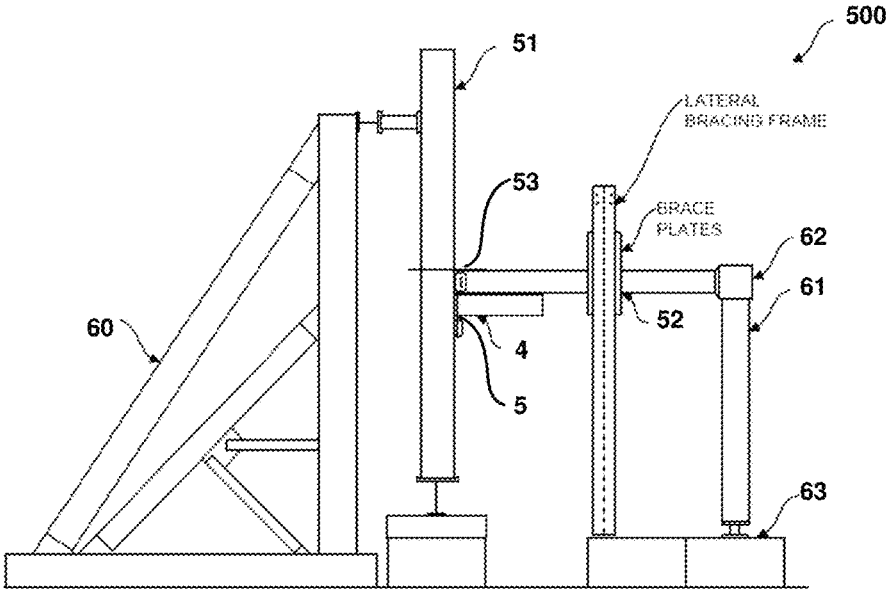
FIG. 5B is a schematic diagram of the Gert Haunch test fixture, for implementing embodiments of the present disclosure.

FIG. 5A is a pictorial view of the Gert Haunch test fixture 500, for implementing embodiments of the present disclosure. FIG. 5B is a schematic diagram of the Gert Haunch test fixture 500, for implementing embodiments of the present disclosure. The test column 51 was raised into place with the Gert Haunch top plate 53 already fitted onto its cross section. The top of the test column 51 was braced to a steel reaction frame 60 to reduce the rotation of the test column during the experiment. Once the test column was secured, the test beam 52 was attached to the shear tab and bolted to the top plate 53. The bend plate 5 was welded to the Gert Haunch 4 prior to assembly of the column-beam connection. The Gert Haunch 4 was bolted to the underside of the test beam 52 and secured to the column 51 using the spacer and retainer plates, as shown in FIG. 3B above. Shim plates 3C were welded to the top plate to provide the bearing surface as described in FIG. 2 above. Hydraulic actuator 61 is mounted between a corbel 62, coupled to the test beam 52 and one or more concrete foundation block(s) 63. The hydraulic actuator can push the test beam in an upward, positive direction, away from the concrete foundation blocks 63 or pull the test beam in a downward, negative direction toward the concrete foundation blocks. The lateral bracing frame 64 is used to prevent the beam 52 from twisting during testing. Frames like this, when constructed in buildings, are connected to a floor system which provides out of plane support and braces the beam 52 from twisting when subjected to loading. The twisting is a common phenomenon in "W" beams that are subjected to bending compression loads and is a function of the amount of load and the length of the beam that is unbraced. Additionally, the connection of the hydraulic actuator 61 can be slightly off center which can cause beam twisting as well. The Gert Haunch 4 provides additional support to the beam 52 which should help this issue.

Figure 5C:
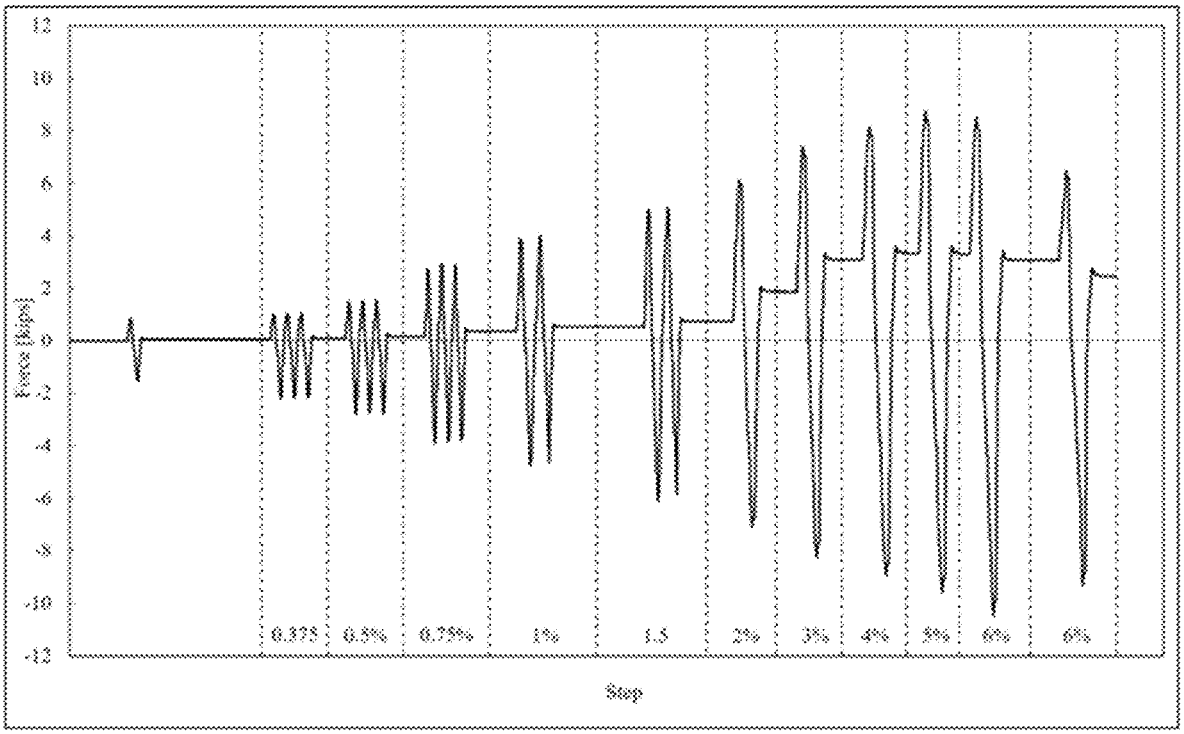
FIG. 5C is a graphical representation of the loading time history recorded during the testing of the Gert Haunch connection, for implementing embodiments of the present disclosure.

The testing procedure was performed in accordance with the AISC 341-16 protocol for Beam-to-Column moment connections. This testing protocol establishes target story drift angles for the rotation of the test beam. Six cycles were performed at 0.375, 0.5 and 0.75 percent drift, followed by four cycles at 1 percent drift. Two cycles are performed each at 1.5, 2, 3, 4 percent and continuing at 1 percent drift increments until connection failure is observed. FIG. 5C is a graphical representation of the loading time history recorded during the testing of the Gert Haunch connection, for implementing embodiments of the present disclosure.

Figure 5D:
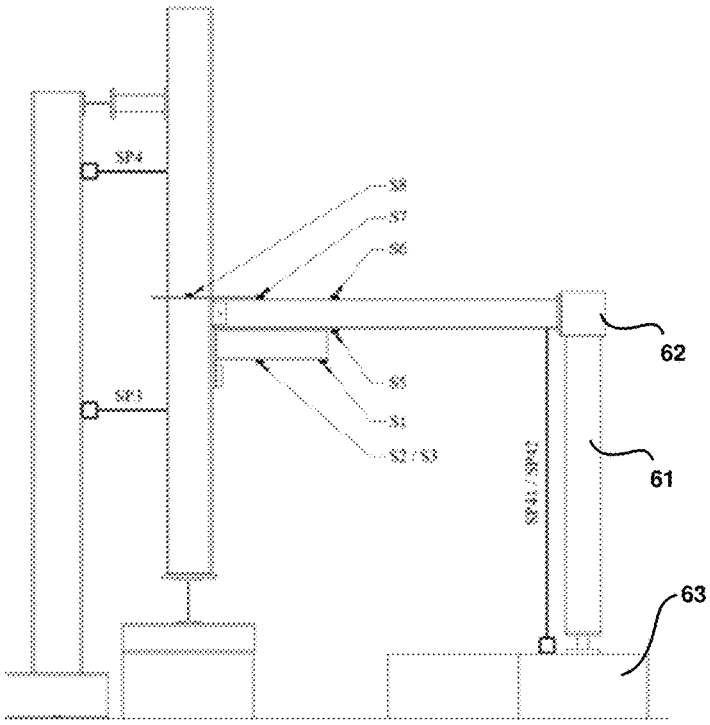
FIG. 5D is a schematic diagram of the strain gauges S and string potentiometers SP used during testing the Gert Haunch connection, for implementing embodiments of the present disclosure.

FIG. 5D is a schematic diagram of the strain gauges S1-S8 and string potentiometers SP3, Sp4, Sp41, SP42 used during testing the Gert Haunch connection, for implementing embodiments of the present disclosure. The behavior of the Gert Haunch connection and test frame was measured using uniaxial strain gages S1-S8 and linear string potentiometers SP3, Sp4, Sp41, SP42. The strain gages were placed along the test beam and Gert Haunch to verify the increased stiffness of adding the Gert Haunch. Linear string potentiometers were placed to measure beam deflection as well as column rotation. Actuator displacement and force values were recorded directly from the hydraulic actuator 61.

Figure 5E:
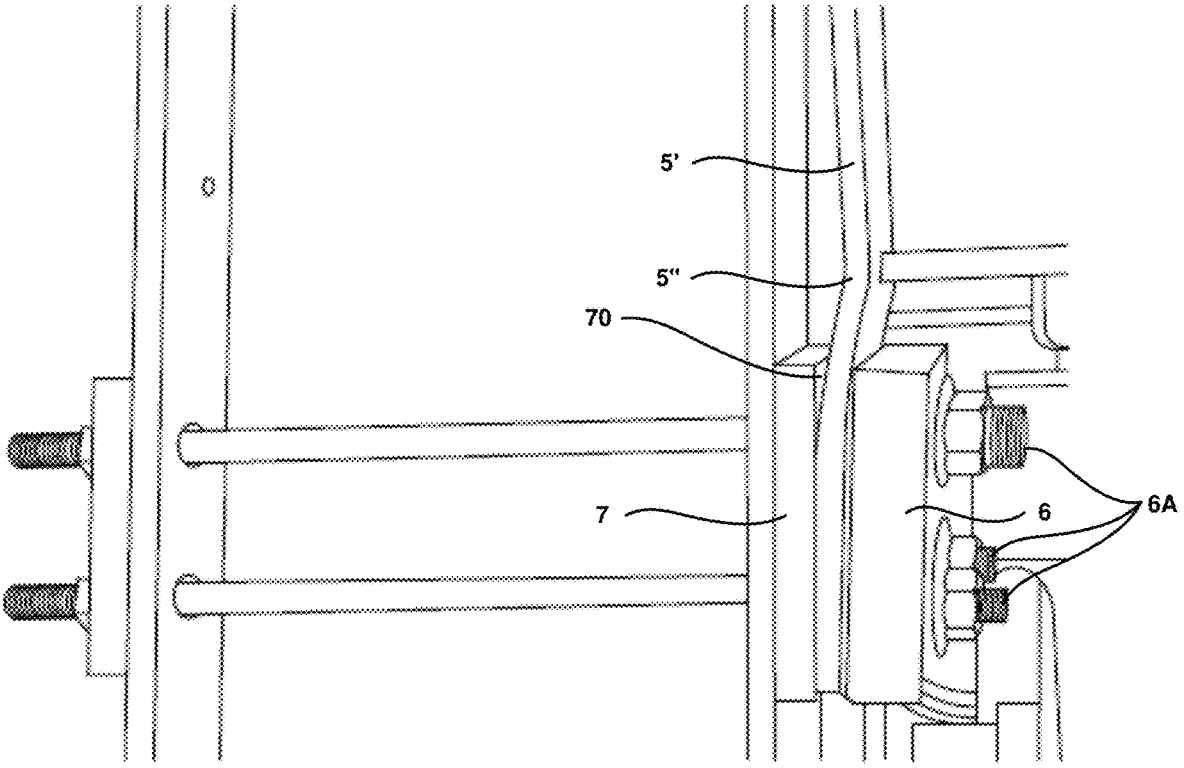
FIG. 5E is a pictorial view of a gap formed between the bend plate and the spacer plate which occurred during testing of the Gert Haunch connection, for implementing embodiments of the present disclosure.
Figure 5F:
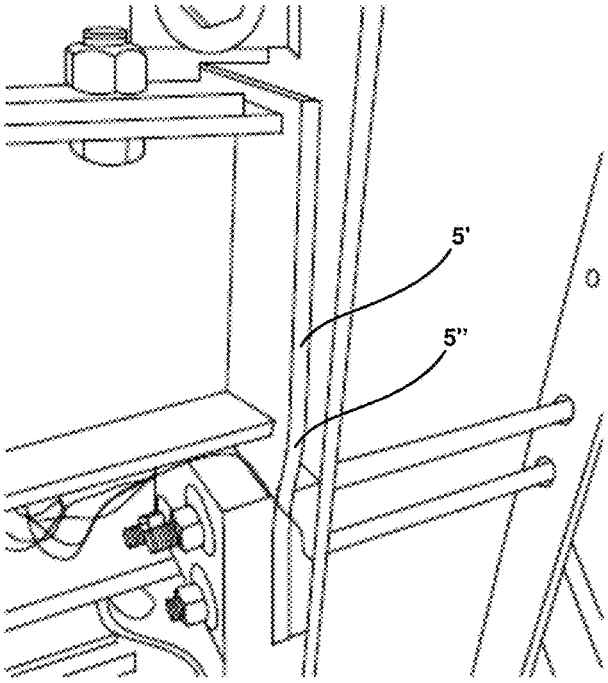
FIG. 5F is a pictorial view of a bent bend plate which occurred during testing of the Gert Haunch connection, for implementing embodiments of the present disclosure.

The results of the recorded test data have been arranged based on the guidelines of AISC 341 K2.7. Throughout the Gert Haunch testing, the cyclic loading instigated bolt slipping between the haunch and the test beam as the displacement of the test beam shifted from positive to negative. This effect was observed in the lower drift cycles but became much clearer as the target drift increased. Horizontal slip between the Gert Haunch and the test beam was visually clear above 1.5 percent drift. Prior to 2 percent drift, the bend plate appeared to perform elastically. Visual yielding of the bend plate element was observed at 2 percent drift in the form of permanent residual curvature. FIG. 5E is a pictorial view of a gap 70 formed between the bent bend plate 5' and the spacer plate 7 which occurred during testing of the Gert Haunch connection, for implementing embodiments of the present disclosure. At the same drift level of 2 percent, one or more of the threaded rods 6A in the bend plate connection began to elongate and bend, allowing the gap 70 to form between the now bent bend plate 5' and spacer plate 7. FIG. 5F is a pictorial view of a bent bend plate 5' which occurred during testing of the Gert Haunch connection, for implementing embodiments of the present disclosure. The negative displacement resulted in the double curvature deformation 5" of the, now bent, bend plate 5', as shown in FIG. 5F.

Beyond 1 percent drift, the top plate would bind to the back column flange until the specimen was rotated back to zero displacement where it would jolt back into a neutral position accompanied with a loud sound.

Figure 6A:
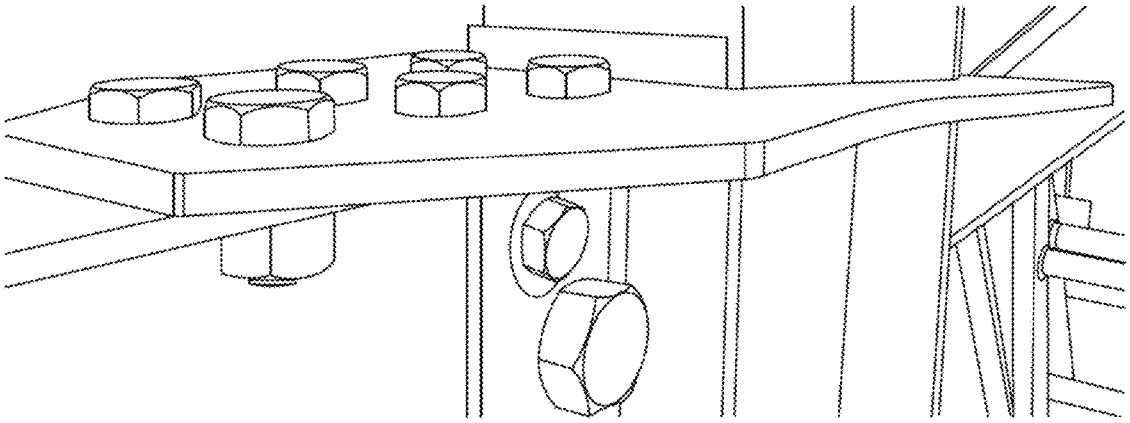
FIGS. 6A-C are pictorial views of Gert Haunch connection bending during testing, for implementing embodiments of the present disclosure.
Figure 6B:
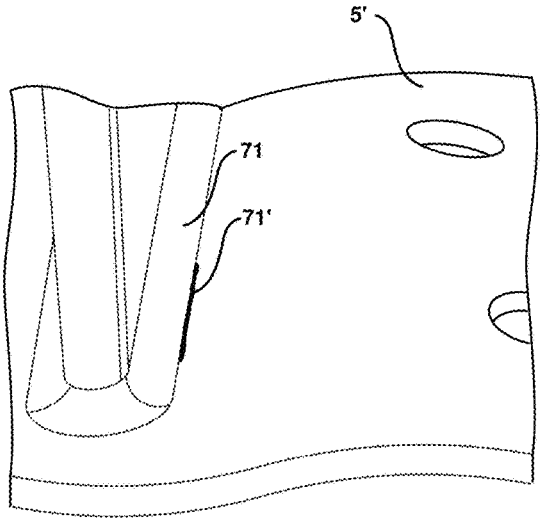
Figure 6C:
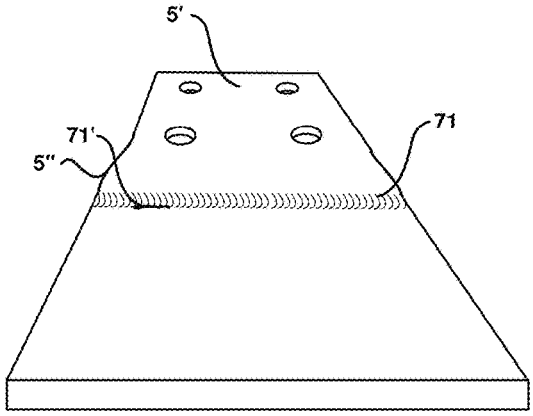

FIGS. 6A-C are pictorial views of Gert Haunch connection bending during testing, for implementing embodiments of the present disclosure. After testing was completed, the state of the test elements was reviewed. The test beam, haunch and column exhibited no significant signs of inelastic behavior. The threaded rods in the bend plate connection sustained severe permanent deformations (e.g., stretching, bending). The top plate sustained permanent flexural deformation along its connection to the top of the beam as shown in FIG. 6A.

The bend plate 5' exhibited clear degradation at the welded connection 71 to the haunch. The partial joint penetration (PJP) weld 71 has begun fracturing 71' along its entire length and cracking was observed through the bend plate as shown in FIGS. 6B, 6C.

Figure 7A:
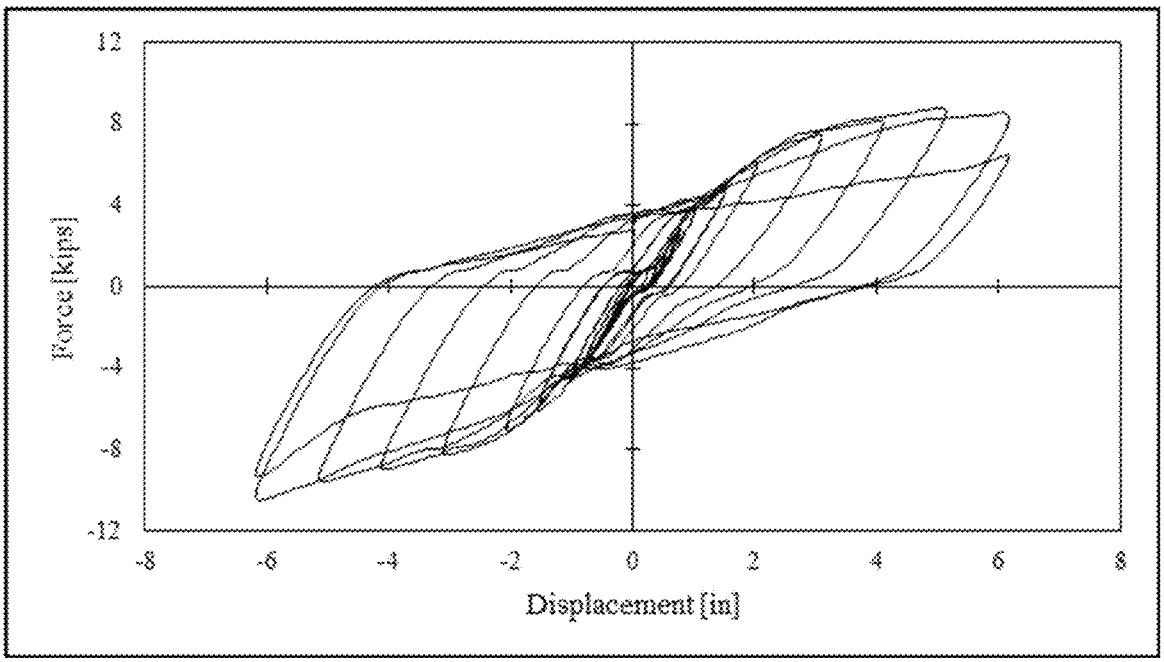
FIG. 7A is a graphical representation of an applied load versus vertical tip displacement of the beam relative to undeformed beam centerline, for implementing embodiments of the present disclosure.
Figure 7B:
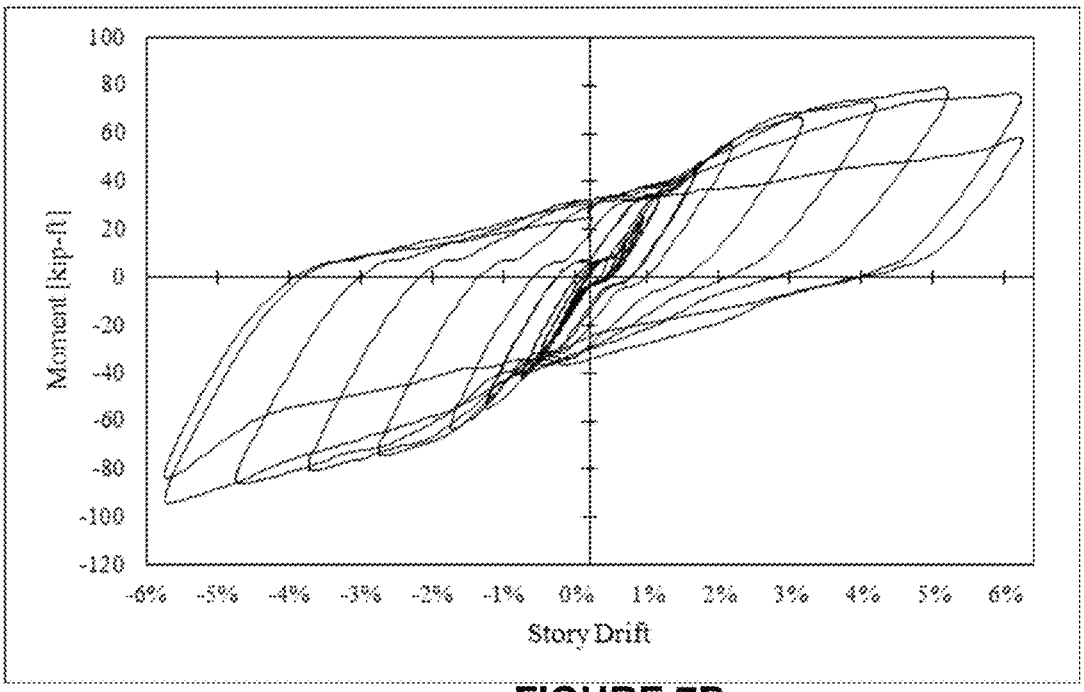
FIG. 7B is a graphical representation of the applied load versus story drift relative to column centerline, for implementing embodiments of the present disclosure.

The response measurements captured from the test protocol are represented in the following visualizations and descriptions. FIG. 7A is a graphical representation of an applied load versus vertical tip displacement of the beam relative to undeformed beam centerline, for implementing embodiments of the present disclosure. FIG. 7B is a graphical representation of the applied load versus story drift relative to column centerline, for implementing embodiments of the present disclosure. The maximum story drift reached by the test specimen was six percent, or 0.06 radians. Strength degradation was observed during this drift cycle, so the testing protocol was terminated to avoid ultimate failure. With the exception of the through bolts in the bend plate connection, inelastic behavior was only observed in the bend plate which acted as the yielding mechanism during the experiment.

Prior to bend plate yielding at about 2 percent drift, the connection exhibited performance in accordance with predicted behavior. Both positive and negative displacements resulted in double curvature bending in the bend plate and the system returned to zero displacement with relatively small residual load. It should be understood that by "about 2 percent" includes a range of between 1.5 and 2.5 percent, e.g., a +/−25 percent range of the base.

In reviewing the hysteretic behavior at the largest drift cycles, it was observed that the maximum positive moment was about 25 percent smaller than the maximum negative moment. The observed gap in the bend plate connection is expected to be the primary cause for this difference as it permitted larger rotations with lower moment demand. In negative rotation, the bend plate still deformed in double curvature as intended and therefore continued to be controlled by its design flexural stiffness.

After reviewing design calculations, it is expected that the demand force to the threaded rods in the bend plate was underestimated. This resulted in forces over 50 percent past the yield capacity of the upper set of rods which allowed the gap to form in the connection. In future testing of the Gert Haunch connection the design theory will be adjusted for this connection to accurately predict the demand.

Due to the preliminary nature of this experiment, additional analysis beyond the scope of the AISC Seismic Provisions was performed to understand the impact of the Gert Haunch connection on the overall performance of the frame. The following sections analyze the performance of the Gert Haunch connection relative to the flexural stresses of the beam and the stiffness of the test frame.

Figure 7C:
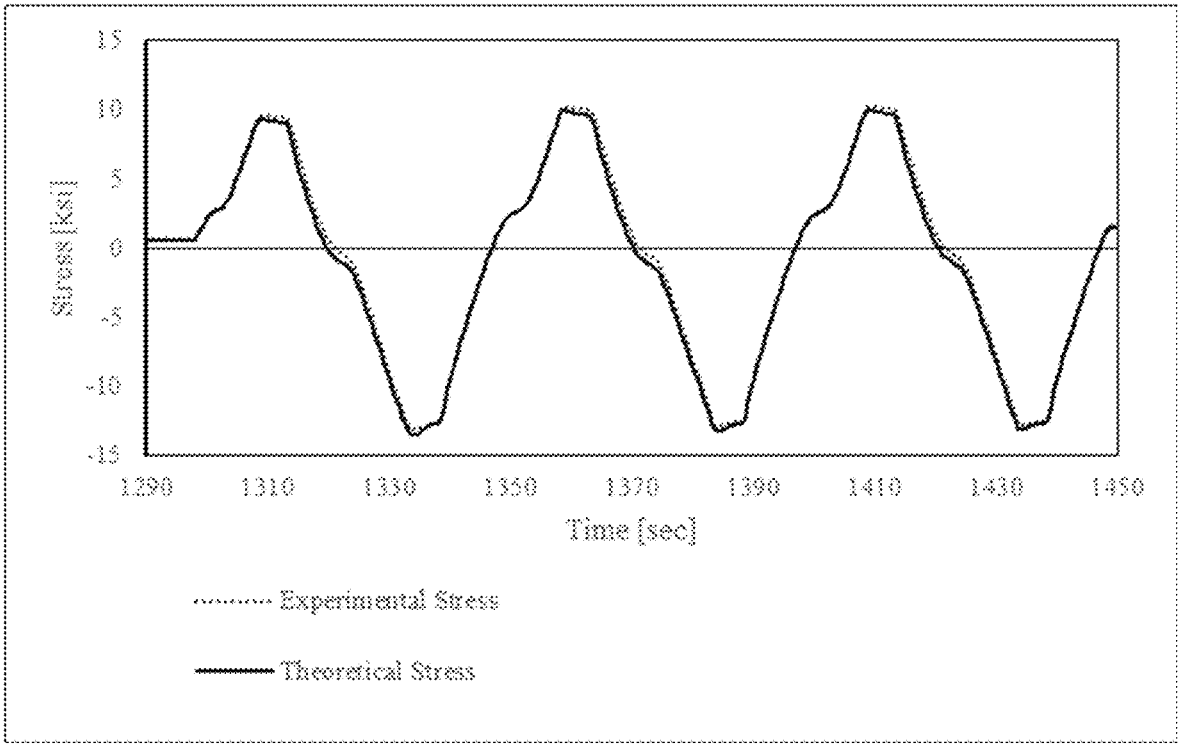
FIG. 7C is a graphical representation of the theoretical response of strain gage (top of the beam flange just beyond the haunch) compared to the experimental data for the 0.5 percent story drift cycle, for implementing embodiments of the present disclosure.

The impact of the Gert Haunch connection on the bending stresses developed in the beam was evaluated using a series of strain gages along the connection length between the two elements. By providing a set of strain gages (S5 and S6) beyond the haunch, the theoretical stress can be validated before the connection begins to impact the results. Using simple beam theory, the theoretical stress at this location can be calculated with Equation 1:

$$\sigma = \frac{My}{I_x} \qquad \text{Equation 1}$$

Where sigma (a) is the stress (s), M is the moment, Y is the distance from the neutral axis to the top of the beam flange, Ix is the moment of inertia of the member about the x axis (strong axis), this is a function of the members geometry. By substituting the member properties of a single W8×21 beam into Equation 1, the theoretical stress can be calculated for any applied load. FIG. 7C is a graphical representation of the theoretical response of strain gage S5 (top of the beam flange just beyond the haunch) compared to the experimental data for the 0.5 percent story drift cycle, for implementing embodiments of the present disclosure. The theoretical prediction shows a correlation to the experimental response which provides a baseline certainty in the performance that is being measured. Similar results are discovered when analyzing the opposite beam flange at strain gage S6, located at the same location along the length of the beam. A W8×21 beam is a conventional call out for the shape, size and weight of a structural steel W-shaped beam where W denotes wide flange, 8 is the nominal depth in inches, and 21 is the weight of the beam in pounds per foot of length.

Figure 7D:
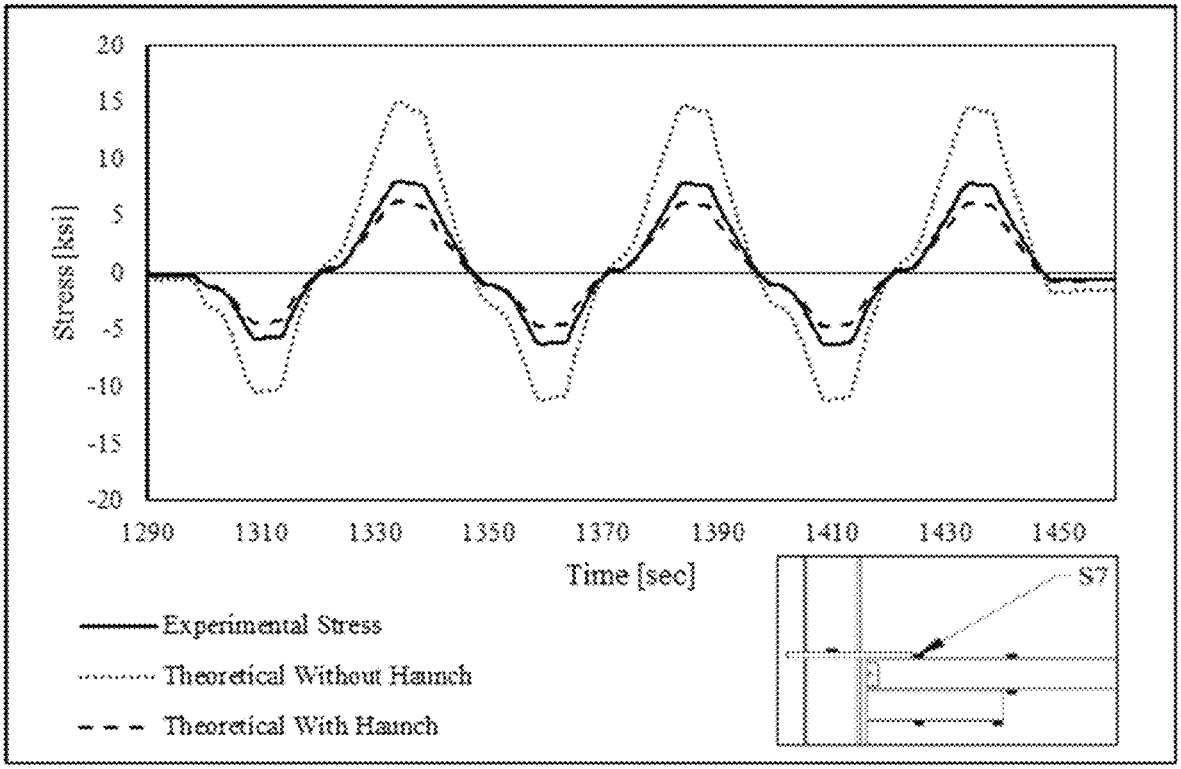
FIG. 7D is a graphical representation of the stress measured by gage during the 0.5 percent drift cycle compared to theoretical estimates with and without the haunch, for implementing embodiments of the present disclosure.

The addition to the gross cross section with the Gert Haunch theoretically increases the moment of inertia dramatically due to the parallel axis theorem (Eq. (2)). In this test setup, the moment of inertia of a single W8×21 beam is 75.3 in 4 in comparison to the combined beam and haunch moment of inertia of 362 $in^4$ $$I_x = \sum I_o + A * d^2 \qquad \text{Equation 2}$$

Where Ix is the total moment of inertia about the strong axis (x) of the combined elements acting as one, Io is the moment of inertia of each individual element, A is the cross-sectional area of each element, d is the distance from the neutral axis to the centroid of the element. This equation is the Parallel Axis Theorem and is a standard, well known formula in engineering mechanics to calculate the moment of inertia of an element that is built up out of several smaller elements. This increase in moment of inertia reduces the maximum theoretical bending stress in the test beam by about 60 percent based on Equation (1). FIG. 7D is a graphical representation of the stress measured by gage S7 during the 0.5 percent drift cycle compared to theoretical estimates with and without the haunch, for implementing embodiments of the present disclosure. On average, the stresses in the beam were reduced by about 52 percent from theoretical values. This results in a 13 percent average difference in predicted behavior when compared to the experiment data.

When modeling a moment frame connection in structural analysis software, a fixed beam-column connection is often assumed to simplify the modeling process. Since a significant portion of the frame beam's rotation is expected to be influenced by the Gert Haunch and connecting elements, a study into the stiffness of the connection itself was performed to match experiment results within analysis software.

The Gert Haunch connection was modeled in structural analysis software using simple frame elements to attempt to capture the method of modeling expected in the design industry. Three section properties are required, one each for the column, beam and combined beam and haunch sections. FIG. 8A is a graphical representation of the flexibility due to the rotation of the connection modeled as a rotational spring at the face of the column, for implementing embodiments of the present disclosure.

The stiffness of the connection rotational spring was derived using a curve fit approach based on the elastic hysteresis performance in the experiment. From the analysis of the test results, the stiffness of the connection is expected to vary slightly in positive and negative rotation. The hysteresis behavior in each direction was isolated to identify any variance in connection stiffness between the two directions.

After matching the connection stiffness to the performance of the test specimen, the approximate rotational stiffness coefficients were as follows: 9,000 kip-feet per radian in positive rotation and 12,000 kip-feet per radian in negative rotation. FIGS. 8B and 8C are graphical representations of the values that were applied to a software analysis model of the test frame and compared to experiment results, for implementing embodiments of the present disclosure. Note that the structural analysis models have been shifted horizontally to match the bolt-slip effect present in the experiment data.

The rotational spring stiffness values chosen to approximate the stiffness along the linear portion of the hysteresis curve match the experimental data with reasonable accuracy. As expected from previous discussion, a lower stiffness was derived for positive displacement when compared to negative displacement. As these values were derived empirically, they are locked to the current geometry used in the test frame. Since varying plate sizes and thicknesses are expected to be selected based on design demands, further study is required to mathematically derive the rotational stiffness of the connection relative to the rotation of the bend plate.

Using the rotational stiffness coefficients derived above, multiple parametric studies were performed to evaluate the impact of the Gert Haunch moment connection on standard moment frames. In this study, the length of the Gert Haunch relative to the beam span was varied to evaluate the impact that haunch length has on overall frame stiffness. Member sizes and materials were taken from the experiment setup, using a W8×21 beam and haunch as well as W12×35 columns, where W12×35 is a W-shaped column with a nominal depth of about 12 inches (300 mm) and a weight of 35 pounds per foot of the column. This is a conventional callout for standard structural steel members. Rotational springs were provided at each beam-column joint with a rotational stiffness of 12,000 kip-feet per radian and 9,000 kip-feet per radian in accordance with previous findings. Three single story moment frame aspect ratios were selected for this parametric study and are described in Table 1.

TABLE 1

Parametric Study Moment Frame Aspect Ratios

| Label | Beam Length, L [ft] | Column Height, H [ft] | Aspect Ratio |
|---|---|---|---|
| MF1 | 13 | 13 | 1:1 |
| MF2 | 20 | 13 | 1.54:1 |
| MF3 | 30 | 13 | 2.31:1 |

For each aspect ratio considered, five haunch lengths were utilized to assess the impact on frame stiffness. The haunch length was taken as a percentage of the beam's span and placed at both beam-column joints in the moment frame. The analyzed haunch lengths were taken at 5, 10, 15, 20 and 30 percent of the beam's length. FIG. 8D is a schematic diagram of a generalized layout of the frame geometry, for implementing embodiments of the present disclosure. The calculated haunch lengths are as follows:

TABLE 2

Parametric Study Haunch Lengths

| Haunch Percentage | MF1 Haunch Length, $L_h$ [in] (cm) | MF2 Haunch Length, $L_h$ [in] (cm) | MF3 Haunch Length, $L_h$ [in] (cm |
|---|---|---|---|
| 5 | 7.8 (19.81) | 12 (30.48) | 18 (45.72) |
| 10 | 15.6 (39.62) | 24 (60.96) | 36 (91.44) |
| 15 | 23.4 (59.42) | 36 (91.44) | 54 (137.16) |
| 20 | 31.2 (79.23) | 48 (121.92) | 72 (182.88) |
| 30 | 46.8 (118.87) | 72 (182.88) | 108 (274.32) |

Lateral load was applied as a point load of ten kips at the top left node. Lateral stiffness of the frame was taken as the applied lateral load divided by the average horizontal deflection of the top of the frame. Frame stiffness results were compared to a standard moment frame model with fixed connection and a single prismatic W8×21 beam. FIG. 8E is a graphical representation of a deflected shape from a sample analysis model, for implementing embodiments of the present disclosure.

FIG. 8F is a graphical representation of the parametric data, for implementing embodiments of the present disclosure. From the 1:1 aspect ratio frame output, it is clear that a minimum haunch length is required to overcome the loss in stiffness due to the flexibility of the connection. All three frames display a relatively linear relationship between haunch length and lateral frame stiffness. From this study, the maximum practical stiffness increases for typical moment frames using the Gert Haunch moment connection ranges from about 10-25 percent when compared to a conventional fixed frame with a single beam.

Figure 8G:
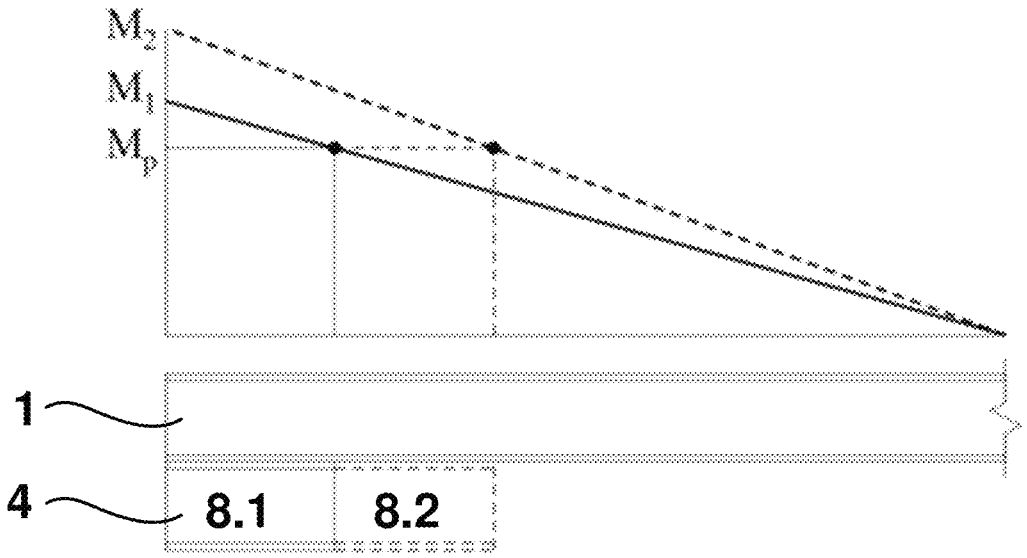
FIG. 8G is a graphical representation of the moment capacity of the Gert Haunch connection, at varying lengths, with respect to the beam alone, for implementing embodiments of the present disclosure.

This study does not account for variation of the connection stiffness itself has a large impact on the lateral stiffness of the frame. The bend plate capacity is selected based on the plastic capacity of the beam, $M_p$. By increasing the haunch's length, the location of the beam's critical section is pushed further into the span. FIG. 8G is a graphical representation of the moment capacity of the Gert Haunch connection, at varying lengths 8.1, 8.2, with respect to the beam alone, for implementing embodiments of the present disclosure. A larger moment demand at the column face increases the demand to the bend plate.

As the haunch gets longer 8.2, the flexural capacity of the bend plate increases to accommodate the new capacity-based moment demand. Increasing the bend plate thickness or decreasing the length of the yielding region to meet the higher design forces would subsequently increase the stiffness of the connection.

The Gert Haunch moment connection was subjected to cyclic testing in accordance with AISC Seismic Provisions. The test frame sustained story drifts larger than 0.04 radians and therefore surpassed the minimum drift requirement to achieve prequalification. The bend plate and accompanying connecting elements exhibited desirable performance until yielding occurred in the bend plate connection. An analysis of the actual load to the bend plate connecting elements was performed to accurately design for future testing experiments. An approximate method for estimating the rotational stiffness of the connection was employed to analyze varying moment frames with the Gert Haunch Connection in software to understand its impact on their stiffness. Further testing and analysis are required to understand the performance of this connection using varying connection geometry and frame member sizes Although the foregoing disclosure has been described in some detail for purposes of clarity of understanding, it will be apparent that certain changes and modifications may be practiced within the scope of the appended claims. Accordingly, the present embodiments are to be considered as illustrative and not restrictive, and the disclosure is not to be limited to the details given herein, but may be modified within the scope and equivalents of the appended claims.

What is claimed is:

1. An apparatus comprising:

a column;

a beam including a first side, a second side and a web, wherein the second side is opposite the first side and the web extends between the first side and the second side, the beam including a beam depth equal to a distance between the first side and the second side; and a haunch having a first haunch side coupled to a first side of the beam and a bend plate secured to a first end of the haunch, the haunch coupled to the column by the bend plate, wherein the bend plate is separated from the column by a spacer plate, wherein a first edge of the spacer plate is separated from a second haunch side by a yielding region, and wherein one or more fasteners secure the bend plate to the column.

2. The apparatus of claim 1, further comprising a top plate, the top plate extending a first distance along the top surface of the beam and the top plate includes a column opening encompassing the column, the top plate being secured to the top surface of the beam by a plurality of fasteners.

3. The apparatus of claim 1, further comprising:

a shear tab coupled to the column and aligned with the web of the beam, the shear tab including a shear tab pivot and at least one shear tab slot, the web of the beam including a rotation opening aligned to the shear tab pivot and the web of the beam further including at least one shear tab opening aligned with the at least one shear tab slot, a first shear tab fastener securing the web of the beam to the shear tab through the at least one shear tab slot and the at least one shear tab opening and a second shear tab fastener securing the web of the beam to the shear tab through the shear pivot and the rotation opening.

4. The apparatus of claim 1, wherein the bend plate is welded to a first end of the haunch.

5. The apparatus of claim 1, wherein the haunch has a haunch depth equal to the beam depth.

6. The apparatus of claim 1, wherein the haunch has a haunch depth less than the beam depth.

7. The apparatus of claim 1, wherein the haunch has a haunch depth greater than the beam depth.

8. The apparatus of claim 1, wherein the bend plate has a bend plate width at least equal to a haunch flange width.

9. The apparatus of claim 1, further comprising a yielding gap between the column and the bend plate, wherein the yielding gap has width equal to a thickness of the spacer plate.

10. The apparatus of claim 1, wherein the haunch has a haunch length less than a length of the beam.

11. A coupling apparatus comprising:

a haunch including a beam segment having:

a haunch length less than a length of a beam;

a first haunch end;

a second haunch end opposite the first haunch end; and a haunch cross sectional size substantially equal to a cross-sectional size of the beam;

a bend plate coupled to the first haunch end, the bend plate extending across a depth of the haunch and further extending across a yielding length and a retainer plate length of a retainer plate;

a spacer plate disposed between the bend plate and a first side of a column, the spacer plate having a spacer plate thickness equal to a yielding gap width, the spacer plate having a spacer plate length equal to the length of the retainer plate;

at least one removable haunch threaded fastener securing the haunch to a first side of the beam, the at least one haunch threaded fastener extending through the first side of the haunch and the first side of the beam, wherein the bend plate is offset from a first side of the column by the yielding width;

the retainer plate disposed on an opposite side of the bend plate from the spacer plate and offset from a bottom of the haunch by the yielding length;

at least one retainer threaded fastener passing through the retainer plate, the bend plate, the spacer plate and at least one side of the column, the at least one retainer threaded fastener securing the retainer plate, the bend plate, the spacer plate to the at least one side of the column;

a shear tab coupled to the first side of the column, the shear tab including a shear tab pivot and an upper shear tab slot formed a first distance above a centerline of the pivot and a lower shear tab slot formed the first distance below the centerline of the pivot;

a substantially round rotation opening formed in the beam corresponding to and aligned with the shear tab pivot, the pivot opening having a diameter substantially equal to a diameter of the shear tab pivot; and an upper shear tab threaded fastener and a lower shear tab threaded fastener passing through the beam and securing the beam to the upper and lower shear tab slots.

12. The coupling apparatus of claim 11, further comprising a top plate, the top plate including a column opening encompassing the column and a top plate length extending along a first portion of the beam on a second side of the beam opposite from the first side of the beam, the top plate being secured to the beam.

13. A method of forming a flexible connection between a beam and a column comprising:

removably connecting a first haunch side of the haunch to a first side of the beam;

securing a bend plate to a first end of the haunch, the bend plate extending away from a second haunch side of the haunch a sum of a yielding length and a retaining plate length, coupling the bend plate to a spacer plate and the first side of the column;

pivotally coupling a web of the beam to the first side of the column; and securing a top plate to the second side of the beam, the top plate including a column opening encompassing the column.

* * * * *